US008664507B1

(12) United States Patent
Lawing

(10) Patent No.: US 8,664,507 B1
(45) Date of Patent: Mar. 4, 2014

(54) MUSICAL INSTRUMENT PICKUP AND METHODS

(76) Inventor: Andrew Scott Lawing, Newark, DE (US)

( * ) Notice: Subject to any disclaimer, the term of this patent is extended or adjusted under 35 U.S.C. 154(b) by 0 days.

(21) Appl. No.: 13/290,896

(22) Filed: Nov. 7, 2011

Related U.S. Application Data

(63) Continuation of application No. 13/223,625, filed on Sep. 1, 2011, now abandoned.

(60) Provisional application No. 61/402,527, filed on Sep. 1, 2010, provisional application No. 61/461,956, filed on Jan. 26, 2011, provisional application No. 61/525,240, filed on Aug. 19, 2011.

(51) Int. Cl.
*G10H 3/00* (2006.01)

(52) U.S. Cl.
USPC ..... 84/723; 84/725; 84/726

(58) Field of Classification Search
None
See application file for complete search history.

(56) References Cited

U.S. PATENT DOCUMENTS

| | | | | |
|---|---|---|---|---|
| 1,915,858 | A | 6/1933 | Miessner | 84/723 |
| 1,933,296 | A | 10/1933 | Jacobs | 84/735 |
| 1,977,939 | A | 10/1934 | Carl | 363/11 |
| 2,089,171 | A | 8/1937 | Beauchamp | 84/726 |
| 2,130,174 | A | 9/1938 | Beauchamp | 84/727 |
| 2,152,783 | A | 4/1939 | Beauchamp | 84/313 |
| 2,225,299 | A | 12/1940 | Demuth | 84/726 |
| 2,228,881 | A | 1/1941 | Le Clair | 84/733 |
| 2,310,199 | A | 2/1943 | Beauchamp | 84/723 |
| 2,455,575 | A | 12/1948 | Fender | 84/726 |
| 2,892,371 | A | 6/1959 | Butts | 84/727 |
| 2,896,491 | A | 7/1959 | Lover | 84/725 |
| 2,933,967 | A | 4/1960 | Riscol | 84/726 |
| 2,976,755 | A | 4/1961 | Fender | 84/727 |
| 3,035,472 | A | 5/1962 | Freeman | 84/726 |
| 3,147,332 | A | 9/1964 | Fender | 84/728 |
| 3,177,283 | A | 4/1965 | Fender | 84/726 |
| 3,249,677 | A | 5/1966 | Ormston et al. | 84/726 |
| 3,483,303 | A | 12/1969 | Warner | 84/728 |
| 3,571,483 | A | 3/1971 | Davidson | 84/726 |
| 3,585,424 | A | 6/1971 | Neel | 310/25 |
| 3,588,311 | A | 6/1971 | Zoller | 84/725 |
| 3,675,529 | A | 7/1972 | Van Der Woerd | 84/455 |
| 3,711,619 | A | 1/1973 | Jones et al. | 84/726 |

(Continued)

FOREIGN PATENT DOCUMENTS

| | | | |
|---|---|---|---|
| WO | WO8704288 | 7/1987 | G10H 3/18 |

OTHER PUBLICATIONS

Donald Brosnac, Guitar Electronics for Musicians, 1983 Wise Publications, pp. 37-38.

(Continued)

*Primary Examiner* — Marlon Fletcher
(74) *Attorney, Agent, or Firm* — The Patent Source

(57) ABSTRACT

Musical instrument pickups and methods of constructing same to achieve a user-desired signal output level and a user-desired tonal characteristic from a stringed instrument are disclosed. The method may include steps for selecting a coil geometry, selecting a number of coils, selecting a coil wire gauge and number of turns for each coil and selecting a pole piece. In selecting the pole piece consideration may be given to pole piece composition, pole piece thickness, height and width, and pole piece response in terms of relative inductive and relative resonant frequency characteristics and/or the shape of the frequency response in the vicinity of resonance.

14 Claims, 18 Drawing Sheets

(56) References Cited

U.S. PATENT DOCUMENTS

| | | | | | |
|---|---|---|---|---|---|
| 3,715,446 | A | | 2/1973 | Kosinski | 84/727 |
| 3,748,367 | A | | 7/1973 | Lamme et al. | 84/679 |
| 3,983,777 | A | | 10/1976 | Bartolini | 84/726 |
| 3,983,778 | A | | 10/1976 | Bartolini | 84/726 |
| 4,096,780 | A | | 6/1978 | Dawson | 84/726 |
| 4,137,811 | A | | 2/1979 | Kakehashi | 84/726 |
| 4,145,944 | A | | 3/1979 | Helpinstill, II | 84/726 |
| 4,181,058 | A | | 1/1980 | Suenaga | 84/726 |
| 4,182,213 | A | | 1/1980 | Iodice | 84/728 |
| 4,212,220 | A | | 7/1980 | Helpinstill, II | 84/726 |
| 4,220,069 | A | * | 9/1980 | Fender | 84/726 |
| 4,230,013 | A | | 10/1980 | Wellings | 84/733 |
| 4,348,930 | A | | 9/1982 | Chobanian et al. | 84/726 |
| 4,364,295 | A | | 12/1982 | Stich | 84/726 |
| 4,372,186 | A | | 2/1983 | Aaroe | 84/725 |
| 4,372,187 | A | | 2/1983 | Berg | 84/722 |
| 4,378,722 | A | | 4/1983 | Isakson | 84/726 |
| 4,499,809 | A | | 2/1985 | Clevinger | 84/726 |
| 4,534,258 | A | | 8/1985 | Anderson | 84/728 |
| 4,535,668 | A | | 8/1985 | Schaller | 84/727 |
| 4,580,481 | A | | 4/1986 | Schaller et al. | 84/727 |
| 4,581,974 | A | | 4/1986 | Fender | 84/725 |
| 4,624,172 | A | | 11/1986 | McDougall | 84/726 |
| 4,654,546 | A | | 3/1987 | Kirjavainen | 307/400 |
| 4,750,397 | A | | 6/1988 | Ashworth-Jones | 84/731 |
| 4,837,836 | A | | 6/1989 | Barcus | 381/118 |
| 4,852,443 | A | | 8/1989 | Duncan et al. | 84/733 |
| 4,907,483 | A | | 3/1990 | Rose et al. | 84/726 |
| 5,012,716 | A | | 5/1991 | Pagelli | 84/727 |
| 5,070,759 | A | | 12/1991 | Hoover et al. | 84/726 |
| 5,111,728 | A | | 5/1992 | Blucher et al. | 84/726 |
| 5,123,324 | A | | 6/1992 | Rose et al. | 84/726 |
| 5,148,733 | A | | 9/1992 | Beller | 84/726 |
| 5,168,117 | A | | 12/1992 | Anderson | 84/726 |
| 5,206,449 | A | | 4/1993 | McClish | 84/723 |
| 5,221,805 | A | | 6/1993 | Lace | 84/726 |
| 5,233,123 | A | | 8/1993 | Rose et al. | 84/726 |
| 5,290,968 | A | | 3/1994 | Mirigliano et al. | 84/726 |
| 5,292,998 | A | | 3/1994 | Knapp | 84/726 |
| 5,335,576 | A | | 8/1994 | Hayashi | 84/727 |
| 5,336,845 | A | | 8/1994 | Lace, Sr. | 84/726 |
| 5,376,754 | A | | 12/1994 | Stich | 84/728 |
| 5,389,731 | A | | 2/1995 | Lace | 84/726 |
| 5,391,831 | A | | 2/1995 | Lace | 84/726 |
| 5,391,832 | A | | 2/1995 | Lace | 84/726 |
| 5,399,802 | A | | 3/1995 | Blucher | 84/726 |
| 5,408,043 | A | | 4/1995 | Lace | 84/726 |
| 5,422,432 | A | | 6/1995 | Lace | 84/726 |
| 5,430,246 | A | | 7/1995 | Lace et al. | 84/726 |
| 5,508,474 | A | * | 4/1996 | Tumura | 84/726 |
| 5,523,526 | A | | 6/1996 | Shattil | 84/728 |
| 5,525,750 | A | * | 6/1996 | Beller | 84/726 |
| 5,530,199 | A | | 6/1996 | Blucher | 84/728 |
| 5,567,903 | A | | 10/1996 | Coopersmith et al. | 84/723 |
| 5,585,588 | A | * | 12/1996 | Tumura | 84/726 |
| 5,610,357 | A | | 3/1997 | Frank-Braun | 84/726 |
| 5,792,973 | A | | 8/1998 | Riboloff | 84/726 |
| 5,894,101 | A | | 4/1999 | Damm | 8/728 |
| 5,932,827 | A | | 8/1999 | Osborne et al. | 84/726 |
| 5,949,014 | A | | 9/1999 | Rashak et al. | 84/725 |
| 6,043,422 | A | | 3/2000 | Chapman | 84/723 |
| 6,078,006 | A | | 6/2000 | Raisanen et al. | 84/733 |
| 6,103,966 | A | * | 8/2000 | Kinman | 84/728 |
| 6,111,184 | A | | 8/2000 | Cloud et al. | 84/723 |
| 6,162,984 | A | | 12/2000 | Engard | 84/743 |
| 6,208,135 | B1 | | 3/2001 | Shattil | 324/225 |
| 6,211,671 | B1 | | 4/2001 | Shattil | 324/225 |
| 6,291,759 | B1 | * | 9/2001 | Turner | 84/726 |
| 6,372,976 | B2 | | 4/2002 | Damm | 84/723 |
| 6,392,137 | B1 | | 5/2002 | Isvan | 84/726 |
| 6,476,309 | B2 | | 11/2002 | Gaglio | 84/726 |
| 6,605,771 | B1 | | 8/2003 | Baggs | 84/731 |
| 6,846,981 | B2 | | 1/2005 | Devers | 84/728 |
| 6,849,792 | B2 | | 2/2005 | Yeakel | 84/298 |
| 6,852,402 | B2 | | 2/2005 | Kirjavainen et al. | 428/305.5 |
| 6,992,243 | B2 | | 1/2006 | Small | 84/267 |
| 7,022,909 | B2 | | 4/2006 | Kinman | 84/726 |
| 7,087,828 | B2 | | 8/2006 | Krieger | 84/545 |
| 7,105,731 | B1 | | 9/2006 | Riedl | 84/200 |
| 7,166,793 | B2 | | 1/2007 | Beller | 84/723 |
| 7,166,794 | B2 | | 1/2007 | Juszkiewicz et al. | 84/728 |
| 7,189,916 | B2 | | 3/2007 | Kinman | 84/726 |
| 7,199,302 | B2 | | 4/2007 | Raisanen | 84/723 |
| 7,227,076 | B2 | * | 6/2007 | Stich | 84/726 |
| 7,259,318 | B2 | | 8/2007 | Chiliachki | 84/728 |
| 7,285,714 | B2 | | 10/2007 | Juszkiewicz et al. | 84/726 |
| 7,375,276 | B2 | | 5/2008 | Kanayama et al. | 84/723 |
| 7,612,282 | B1 | | 11/2009 | Lawing | 84/726 |
| 7,718,886 | B1 | | 5/2010 | Lace | 84/727 |
| 7,982,123 | B2 | | 7/2011 | Mulvany | 84/726 |
| 7,989,690 | B1 | | 8/2011 | Lawing | 84/726 |
| 7,994,413 | B2 | * | 8/2011 | Salo | 84/726 |
| 2002/0020281 | A1 | | 2/2002 | Devers | 84/728 |
| 2002/0069749 | A1 | | 6/2002 | Hoover et al. | 84/738 |
| 2002/0083819 | A1 | | 7/2002 | Kinman | 84/726 |
| 2002/0092413 | A1 | * | 7/2002 | Turner | 84/726 |
| 2003/0051596 | A1 | | 3/2003 | Gustafsson | 84/723 |
| 2004/0003709 | A1 | | 1/2004 | Kinman | 84/728 |
| 2005/0028669 | A1 | | 2/2005 | Kavanaugh | 84/726 |
| 2005/0076775 | A1 | | 4/2005 | Small | 84/743 |
| 2005/0081703 | A1 | | 4/2005 | Hoover | 84/726 |
| 2005/0126377 | A1 | | 6/2005 | Kanayama et al. | 84/726 |
| 2005/0162247 | A1 | | 7/2005 | Beller | 335/179 |
| 2006/0112816 | A1 | | 6/2006 | Kinman | 84/728 |
| 2006/0150806 | A1 | | 7/2006 | Hara | 84/726 |
| 2006/0156911 | A1 | | 7/2006 | Stich | 84/726 |
| 2006/0272469 | A1 | | 12/2006 | Meisel | 84/21 |
| 2006/0283311 | A1 | | 12/2006 | Hosler | 84/723 |
| 2007/0017355 | A1 | * | 1/2007 | Lace | 84/728 |
| 2007/0056435 | A1 | | 3/2007 | Juszkiewicz et al. | 84/726 |
| 2008/0245218 | A1 | | 10/2008 | Stewart | 84/727 |
| 2009/0255397 | A1 | * | 10/2009 | Mulvany | 84/726 |
| 2010/0101399 | A1 | | 4/2010 | Calvet | 84/726 |
| 2010/0122623 | A1 | * | 5/2010 | Salo | 84/726 |
| 2011/0048215 | A1 | | 3/2011 | Lace | 84/726 |
| 2011/0100200 | A1 | | 5/2011 | Mayes | 84/726 |

OTHER PUBLICATIONS

Helmuth E.W. Lemme, The Secrets of Electric Guitar Pickups, originally published in Electronic Musician, Dec. 1986, pp. 66-72, updated version published online at http://buildyourguitar.com/resources/lemme/, Feb. 25, 2009.

Leslie Green, RF Inductor Modeling for the 21st Century, EDN: Electronic Design, Strategy, News, Sep. 27, 2001, pp. 67-74.

Steven Errede, Electronic Transducers for Musical Instruments, AES Seminar, UIUC, Nov. 29, 2005, published online at http://online.physics.uiuc.edu/courses/phys498pom/Lecture_Notes/Guitar_Pickup_Talk/.

N. Knotos, et al., Inductive Response of Ferrites Based on Resonance Effects, Journal of Optoelectronics and Advanced Materials vol. 8, No. 5, Oct. 2006, p. 1770-1774.

Mario Milan, Pickups: Windings and Magnets . . . and the Guitar Became Electric, 2007 Centerstream Publishing, pp. 71-97.

Dirk Wacker, Beefing Up Single Coils, Premier Guitar, Aug. 2007, available online at http://www.premierguitar.com/Magazine/Issue/2007/Aug/.

Wallace Marx, Putting the Hex On: the Postmodern Pickups, Premier Guitar, Feb. 2010, p. 60, available online at http://www.premierguitar.com/Magazine/Issue/2010/Feb/Putting_the_Hex_On_the_Postmodern_Pickups.aspx.

Chart showing inherent frequency response of various prior art pickups as noted therein, Prior Art Figure 7, admitted prior art, one sheet.

Two color charts showing inherent frequency response of various prior art pickups as noted therein, Prior Art Figure 13, admitted prior art, one sheet.

Peter D. Hiscocks, Measuring Impedance and Frequency Response of Guitar Pickups, Syscomp Electronic Design, Ltd Applications Note, Apr. 30, 2011, available online at http://www.syscompdesign.com/AppNote.html#AppEd.

* cited by examiner

MUSICAL INSTRUMENT PICKUP AND METHODS

CROSS REFERENCE TO RELATED CASES

This continuation application claims the benefit under 35 U.S.C. §120 of U.S. patent application Ser. No. 13/223,625 filed Sep. 1, 2011 now abandoned and entitled "Musical Instrument Pickup And Methods", which application is hereby incorporated by reference in its entirety and which application, in turn, claimed the benefit under 35 U.S.C. 119(e) of U.S. Provisional Application Ser. No. 61/402,527 filed Sep. 1, 2010 and entitled "Musical Instrument Pickup and Methods"; Ser. No. 61/461,956 filed Jan. 26, 2011 and entitled "Musical Instrument Pickup and Methods"; and Ser. No. 61/525,240 filed Aug. 19, 2011 and entitled "Musical Instrument Pickup and Methods".

BACKGROUND OF THE INVENTION

1. Field of the Invention

This invention relates to musical instrument pickups and, more particularly, to methods of characterizing, correlating and predicting pickup performance to thereby design and construct musical instrument pickups with a predictable tonal response. Accordingly, the general objects of the invention are to provide novel systems, methods, apparatus and models of such character.

2. Description of the Related Art

Certain musical instruments, especially electric guitars and other electric stringed instruments, use magnetic transducers to convert mechanical string vibrations into electrical signals that are subsequently amplified and fed into a loudspeaker. A musician typically selects musical instrument electronic components from a wide variety of options to achieve a particular musician-desired tonal quality. Tonal quality is important as it imparts an expressive element from a musician to a listener. For example, a guitar player may prefer analog circuitry over digital circuitry to achieve a more "vintage" tone. A guitar player's tone is directly related to the selection of desired amplifiers, guitars, and pickups (in addition to the playing style, finger pressure, etc., of the guitar player). With respect to guitar pickups, many factors, such as the number of coil winds, wire types, magnets, pole piece material, etc., are known to affect the tonal qualities of the pickup.

Many electric guitars use single-coil pickups. A significant and persistent drawback to traditional single coil pickups is noise. Due to their lack of active or effective passive noise reduction, single coil pickups are plagued by the fact that they tend to produce large amounts of background noise due to their tendency to pickup and transmit ambient electromagnetic signals, especially at higher gain amplification settings. This significant drawback of single coils pickups has inspired pickup designs that are intended to mimic the tonal characteristics of traditional single coil pickups while providing reduced noise levels. Such pickups are manufactured and/or marketed by a number of companies including; Fender® Musical Instrument Company, Kinman®, Lace® Sensor, DiMarzio®, Seymour Duncan®, Lindy Fralin® and others.

In reference to pickups designed to be direct replacements to traditional single coil pickups for the Fender® Stratocaster® and similar designs, many attempt to follow the basic dimensions of a traditional pickup. One popular design utilizes "stacked" coils, where the overall coil height (in the direction perpendicular to the longitudinal axis of the string) and width (along the longitudinal axis of the string) are similar or identical to a traditional pickup. Instead of a single coil, two coils are utilized, one "stacked" above the other, with the two coils incorporating opposite winding direction, and opposite magnetic orientation with respect to each other. In this way, the stacked coils are reverse-wound/reverse-polarity relative to each other and act to cancel noise while maintaining signal integrity, much as a "humbucking" pickup does. In these stacked designs, great pains can be taken to "tweak" the design parameters (wire size and type, number of turns, magnetic strength, etc.) in order to match the tone of a traditional single coil pickup as closely as possible. Stacked designs are marketed by Kinman® and DiMarzio® among others.

Other designs, such as the Seymour Duncan® Duckbucker®, use two coils; one for strings 1-3 and a second for strings 4-6. The coils are aligned at a constant angle relative to the longitudinal axis of the string, but are offset relative to each other with respect to the longitudinal axis of the string. This type of approach can be designed to fit into a traditional single coil space (such as the Duckbucker®) or the same approach can be designed to fit into a traditional Gibson® humbucker sized package (such as the Seymour Duncan® Twangbanger® or custom shop "3+3" series of offerings). In a recent market entry, Lindy Fralin® has developed a "split blade" design, where a projection of the blade pole piece overlaps the space between the $3^{rd}$ and $4^{th}$ (G and D, respectively) strings in an attempt to minimize the signal loss in this region.

While some of these approaches have enjoyed commercial success, there is still a feeling among many guitarists that they do not quite match the tonal characteristics of a traditional single coil pickup. It should also be noted that all of the designs intended to directly replace traditional single coil pickups must, by definition, fit into the same form factor and utilize the same mounting dimensions as their traditional counterparts as much as possible.

In fact, while the process of designing and manufacturing a high quality pickup remains as much of an art as a science, many of the designs follow the dimensions and electro-magnetic coupling patterns of their traditional counterparts as much as possible. This is at least in part because conventional thought in the art steadfastly posits that geometric concerns such as the orientation of the windings relative to the magnetic field and the vibrating string are critical to achieving a similar tone. For example, the stacked designs where the lower coil is typically a "noise sensing" coil are perceived to be tonally inferior to standard single coil designs, presumably due to the tone affecting properties of the subservient lower coil. As another example, Lindy Fralin's split blade design diverges from traditional design in incorporating continuous blade pole pieces rather than the discrete cylindrical pole pieces incorporated in standard designs. These design changes are viewed as necessarily resulting in tonal characteristics that are distinct from traditional single coil pickups.

Another single coil design is the "P90" pickup. P90 pickups are also prone to noise issues. A P90 pickup is basically a single coil with a different aspect ratio compared to a typical single coil pickup as utilized on a Fender® Stratocaster. The P90 coil is typically shorter than a Stratocaster® coil (i.e. in the direction parallel to the pole piece and perpendicular to the string axis) and wider in terms of the aperture it presents to the vibrating string (i.e. the direction perpendicular to the pole piece and parallel to the string axis). The P90 therefore senses the string vibration over more of the length of the string compared to a typical Stratocaster® single coil pickup. In addition, the P90 typically utilizes a magnetically susceptible pole piece (typically a steel screw) rather than a permanently magnetic pole piece. The magnetic field in P90 pickups is typically supplied by rectangular plate magnets positioned at the base of the pickup and in proximity to the screw pole pieces. There is a "staple" design P90 style pickup that does utilize permanently magnetic pole pieces.

Some designs have emerged to combat P90 noise. These designs are based on a very old design introduced by the Gibson® guitar company for the EBO bass guitar. Rather than a single coil, these designs utilize two coils positioned transversely, such that a permanent magnet is positioned in the center of each coil. The magnets are still positioned in proximity to the pole pieces similar to the traditional design (although the magnets would generally be closer to the vibrating string as they are no longer at the base of the pickup) but the coils themselves are rotated 90 degrees with respect to the long axis of the string. This results in a fundamental change in the way the vibrating string signal is coupled into the pickup and would ultimately have a different tonal signature compared to a traditional P90 pickup.

In another attempt to reduce single coil noise, "dummy coils" have been utilized to provide basically an antenna designed to capture noise of the same magnitude but opposite phase as the noise associated with the pickup while minimizing the tonal interference from the dummy coil. This system is manufactured by Suhr (the Backplate Silent Single Coil or "BPSSC" system) and as of this writing, it retails for on the order of $250. As a comparison a set of 3 new high quality traditional single coil pickups retails for about $190 (Fender® Custom Shop Pickups) to $240 (Lollar hand wound "boutique" pickups). This would indicate that some guitar players are willing to pay more than double the cost of pickups alone (not including installation) to achieve a traditional single coil guitar tone with reduced noise.

In U.S. Pat. Nos. 7,612,282 and 7,989,690 embodiments and methods for, inter alia, reducing the hum but still maintaining the tonal characteristics and basic dimensions of traditional single coil pickups were disclosed. The pickups disclosed in U.S. Pat. Nos. 7,612,282 and 7,989,690 provide significant noise reduction (compared to traditional pickups) while maintaining the basic tonal characteristics associated with the traditional pickup. There are two primary reasons for this: 1) all coils are active in the sensing and generation of signal (i.e. there are no dummy or secondary coils whose primary function is to cancel noise signal but not contribute substantially to the generation of string signal) and 2) the overall geometry and configuration of the coil arrangement and magnetic field of the traditional pickup is maintained. One design consideration of this style of pickup is the importance of presenting a consistent magnetic field across all strings.

Other multiple coil guitar pickup configurations have been taught, but an exhaustive review of the literature will not be given here.

The quality and applicability of a guitar pickup is defined by the tonal quality that it imparts on the note. Much of the process of designing a pickup is done empirically, and even that using minimal deviations from traditional materials and designs for the most part. Traditionally, a limited range of materials has been used in the majority of electric guitar pickup design and construction. Very little work has been done to quantify basic pickup electrical response and tie it to tonal performance. The effect of material properties on pickup performance, while recognized as important, has been very poorly and incompletely understood. To date the only known exceptions to the above noted general rule are the work of Helmuth E.W. Lemme, and Prof Steven Errede at the Univ. of Illinois to measure and characterize electric guitar pickup frequency response. Specifically, Lemme and Errede analyze pickup output, gain or impedance as a function of frequency and to graphically represent the same using rudimentary Bode plots. Their work, however, falls far short of the sophistication necessary to accurately capture the essence of the surprisingly complex nature of guitar pickups.

SUMMARY OF THE INVENTION

In light of the foregoing, an object and feature of the present invention is to provide a method-of-designing/system-for-constructing a pickup that allows for targeting a wide range of tonal characteristics on a common platform. The material characterization and modeling methods taught herein can identify materials and structures that enable the design/construction of pickups with a wide range of targeted pickup tonalities. Thus, inventive pickups, while outwardly appearing to be substantially similar to one another, may either provide tonal characteristics similar to or distinctly different from, traditional pickups. This may be achieved by selecting the appropriate wire gauge and number of windings, coil geometry and layout, magnetic geometry, magnet composition and strength, and/or especially the composition, dimensions and geometry of the magnetically permeable material filling the interior of the pickup coil, to target desired inductive properties and frequency response. For example, the modeling and design aspects of the present invention may be used to design/construct a pickup with a tonal response similar to that of traditional single coil pickup using AlNiCo alloy pole pieces without the use of AlNiCo at all. Alternatively, the modeling and design aspects of the present invention may be used to design/construct pickups with heretofore unknown tonal characteristics.

More particularly, the invention may take the form of a method of constructing a musical instrument pickup to achieve a user-desired signal output level and a user-desired tonal characteristic from a stringed instrument. The method may include the steps of selecting a coil geometry, selecting a number of coils, selecting a coil wire gauge and number of turns for each coil and selecting a pole piece. In selecting the pole piece consideration may be given to pole piece composition, pole piece thickness, height and width, and pole piece response in terms of relative inductive and normalized resonant frequency characteristics. The method may also include the step of assembling the pole piece and coil into a pickup for detecting a musical instrument string vibrating in proximity therewith. If the selected pole piece is non-magnetic, the method may also include steps for selecting a magnet and assembling the pickup with the magnet.

A further object and feature of the present invention is to provide a musical instrument pickup design platform that maintains symmetry between the coil geometry and the associated magnetic field.

Still another object and feature of the present invention is to provide a method of constructing a musical instrument pickup that provides improved symmetry between the coil geometry and the associated magnetic field.

In a related form, the present invention satisfies the above-stated needs and overcomes the above-stated and other deficiencies of the related art by providing a musical instrument pickup made in accordance with the aforementioned inventive system. An inventive pickup for a stringed musical instrument may have at least one coil, at least one laminated pole piece and, if the pole piece is non-magnetic, at least one magnet. The pole piece is not an AlNiCo alloy, but the relative inductive and resonant frequency characteristics of the pole piece are substantially similar to an AlNiCo alloy.

In another related form, the invention may comprise a pickup for a stringed musical instrument having at least one coil, at least one pole piece and, if the pole piece is non-magnetic, at least one magnet. The pole piece may be disposed within the at least one coil, wherein the pole piece material is selected based on the relative inductance and the relative resonant frequency that have been normalized to a reference coil, an exponential parameter alpha; and the shape of the phase angle response near a resonant frequency.

In a preferred form such pickups comprise a plurality of coils positioned around one or more pole pieces. The coils may be oriented such that a long axis thereof forms a constant acute angle with respect to the longitudinal axis of the string. The pole pieces may be either permanently magnetic, or they may be of a magnetically permeable material such as a steel screw, rectangular plate or slug, a plurality of thin magnetically permeable sheets, a laminate composed of a plurality of magnetically permeable sheets, or other magnetically permeable matrix. The pole pieces may also substantially fill the unwound inner core of the coil, or only partially fill it. The design and composition of the pole pieces is arrived at through the use of the aforementioned model which allows for the targeting of specific desired tonal characteristics.

In accordance with an optional feature of the invention, a pole piece and coil wire wrapping pair may, optionally, be associated with a pole piece cap, such that the pole piece cap substantially follows the contours of the coil wire wrapping and the boundaries of the pole piece cap area are intermediate between the coil wire wrapping interior and the outer boundary of the coil wire wrapping. The pole piece cap may be fabricated from a magnetic or a magnetically permeable material, such that the magnetic flux associated with the pole piece is extended to the boundaries of the pole piece cap, especially in the area between adjacent coil wire wrapping pole piece pairs. The coil geometry relative to the string may be arranged to provide for each coil being substantially associated with a single string, while simultaneously maximizing the overlap particularly between strings 3 and 4 and also minimizing the overall projected area of the pickup. In such optional embodiments, coils 1-3 (servicing strings 1-3) may be arranged such that their geometric centers fall along a first line, and coils 4-6 are arranged such that their geometric centers fall along a second line, such second line being parallel to such first line. Both the first and the second line may intersect coil wire wrappings from each of the coils as well as intersecting the interiors of each of the coil wire wrappings. This configuration may alleviate non-idealities associated with reduced signal strength and coupling of string vibration in the space between adjacent pole pieces of opposite magnetic polarity.

Naturally, the above-described methods of the invention are particularly well adapted for use with the above-described apparatus of the invention. Similarly, the apparatus of the invention are well suited to perform the inventive methods described above.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings wherein like numerals represent like steps and/or structures and wherein.

DETAILED DESCRIPTION OF THE PREFERRED EMBODIMENTS

Figure 1:
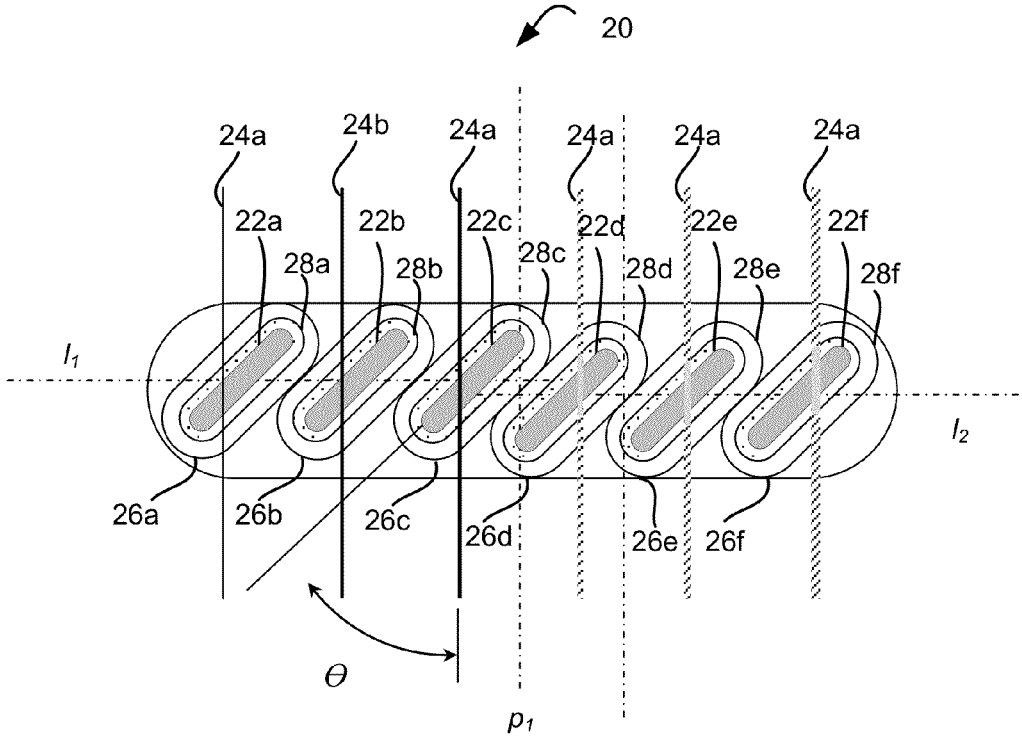
FIG. 1 represents a schematic top view of a preferred pickup with rectangular or stadium cross section pole pieces and pole piece caps associated with each pole piece.

A first embodiment of an inventive pickup 20 is illustrated in FIG. 1. As shown therein, pickup 20 consists of a plurality of pole pieces 22*a*-22*f* that may be composed of generally rectangular plates characterized by a length, height and thickness (or width). As defined here, the height of the pole piece is the dimension perpendicular to the string plane and the string plane is the plane of the page surface. Further, those of ordinary skill will appreciate that the term "string plane", as used herein, may sometimes refer to a slightly curved surface (such as the cylindrical surface), for example, where an instrument fingerboard is radiused and the strings arced accordingly. The length of each pole piece may be positioned to form a constant acute angle, illustrated in FIG. 1 as the angle θ, with respect to the axis of a corresponding string 24*a*-24*f*. Each of pole pieces 22*a*-22*f* may be formed of a permanently magnetic material, such as AlNiCo II or AlNiCo V. Alternatively, pole pieces 22*a*-22*f* may be formed of a magnetically permeable material, such as iron, steel, a nickel-iron alloy or a laminate thereof. The magnetically permeable material may be a solid mass, a powder or aggregate, or it may be composed of a plurality of sheets of material. When in sheet form, the sheets may be laminated together to form a solid structure. As discussed in greater detail below, the particular material and structure of the pole pieces will be selected by a designer to achieve an intended and predictable result using the modeling and design aspects of the invention discussed below.

With continuing reference to FIG. 1, one of the coils 26*a*-26*f* may be associated with each pole piece, such that the coil has a cross section approximating a stadium. In this embodiment, the inner coil wrapping may cover the outer surface of the pole piece (if wound directly on the pole piece), or alternatively the outer surface of the bobbin, and approximate the aspect ratio defined by the length and thickness (or width) of the pole piece. In this way, the pole piece is positioned within the hollow center of the stadium-shaped coil. The coil may be directly wound on the pole piece, or wound on a bobbin or support. Alternatively, the coil may be of the self-supporting type and designed such that the pole piece will slip inside of it.

When using a laminated pole piece in connection with the preferred embodiments discussed herein, it may be desirable or necessary to associate a pole piece cap with one or more of the pole pieces. The pole piece cap should be designed so as to not disturb the magnetic field shape with respect to the coil, such that the pole piece cap conforms to the coil shape, and especially the coil projection onto the plane defined by the strings such that the cap dimensions are concentric with or equivalent to the cross section of at least one turn of the coil windings. The cap acts to extend the region of high permeability, and subsequently the magnetic flux, into the gap between adjacent strings slightly and thereby increasing the overlap of string sensitivity between adjacent strings, but the mass and dimensions of the cap should be minimized as much as possible to minimize the effect of the cap on the magnetic circuit and the inductive response of the coil.

In the particular context of the pickup of FIG. 1, each of pole piece caps 28*a*-28*f* may be defined by stadium cross sections that approximate the respective stadium cross sections of each of pole pieces 22*a*-22*f*. The dimensions of each pole piece cap 28*a*-28*f* may be such that its length and thickness are intermediate between the respective length and width of the inner and outer coil wire wrappings. Pole piece caps 28*a*-28*f* are preferably fabricated from a magnetically permeable material. Each pole piece cap 28*a*-28*f* is preferably affixed to, placed onto, or positioned on one end of a corresponding coil via epoxy or other adhesive, adjacent to a pole piece 22*a*-22*f* and directly below a string, such that its perimeter is at least generally concentric with the coil wire wrappings. In this way, each of pole piece caps 28*a*-28*f* extend the magnetic field from the pole piece 22*a*-22*f* further into the gap between adjacent strings to create a pickup pattern that is more uniform/continuous between adjacent strings (than would be the case without the use of caps). This is especially true in the case of opposing magnetic fields associated with the pole pieces of adjacent strings (pieces 22*c*-22*d* in the case of this preferred embodiment). Also, use of the pole piece caps maintains the natural symmetry of the magnetic field associated with the pole piece and coil.

Pole piece caps 28*a*-28*f* may perform multiple functions. They may contain the pole piece material within the confines of the core of the coil. Especially in the case of a laminate or series of thin sheets forming the pole piece, a cap may contain the material within the core and may form an effective boundary for the "top" end of the core (note that in this discussion "laminate" will be used to denote a plurality of thin sheets or lamina, which may be loose or bonded together). Also, in the case where the pole piece is formed by a series of sheets or a laminate, the pole piece cap may provide a clean and finished appearance. In the case of a pole piece material that is subject to corrosion, such as iron or low carbon steel, the pole piece cap may act as a barrier to corrosive attack. From this standpoint, a 400 series stainless steel, and most preferably 410 stainless steel, provides a corrosion resistant barrier as well as a highly magnetically permeable and relatively tonally "transparent" pole piece cap.

Figures 2A, 2B:
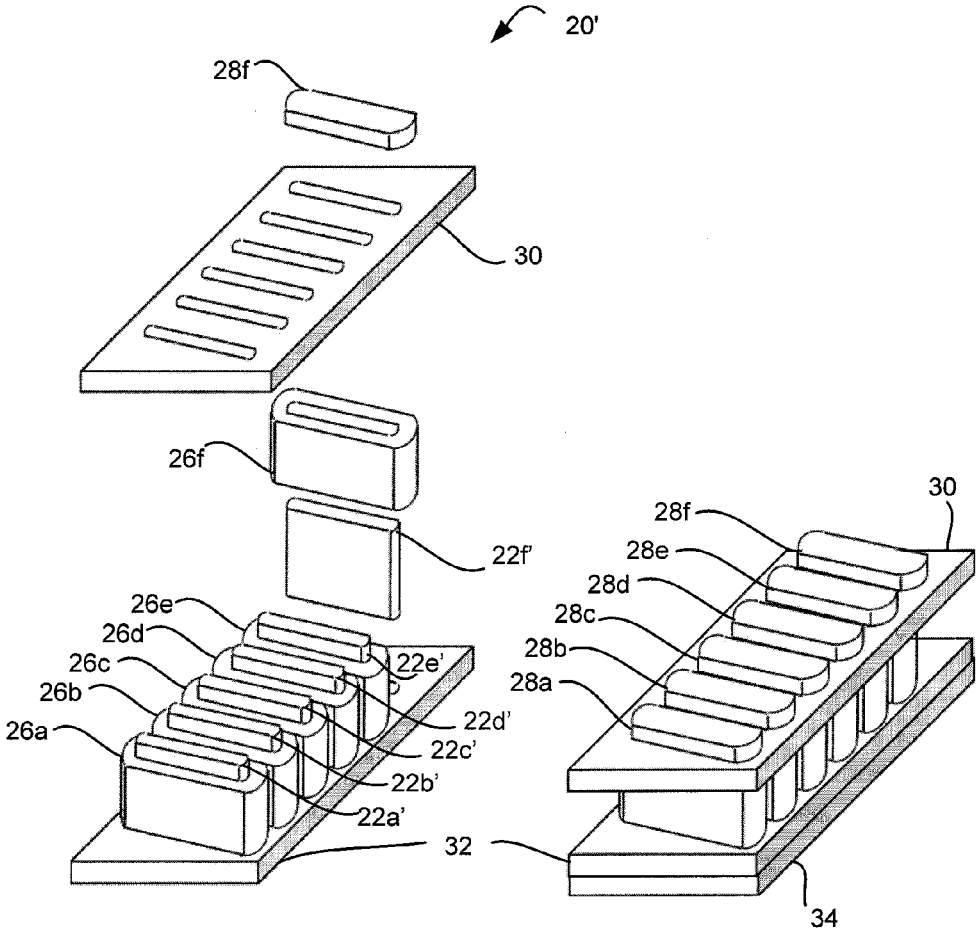
FIG. 2*a* and FIG. 2*b* are exploded diagrams illustrating the assembly of preferred pickups with rectangular plate pole pieces, one of which also utilizes a base plate magnet.
Figure 3:
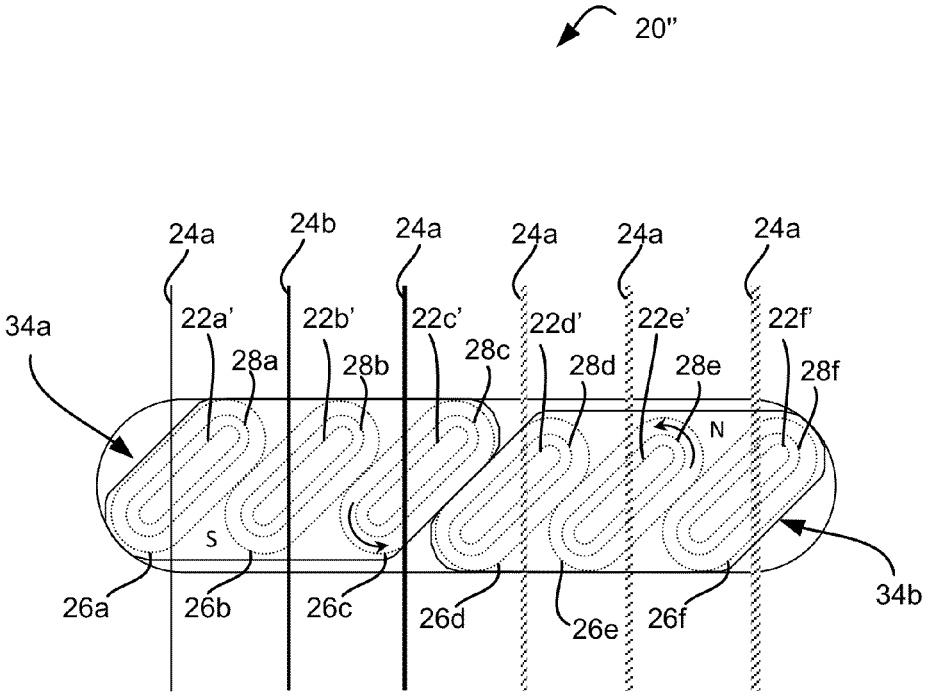
FIG. 3 shows the magnetic and coil winding orientations of a preferred pickup with rectangular plate pole pieces and base plate magnets designed for full hum cancelling operation.
Figure 4:
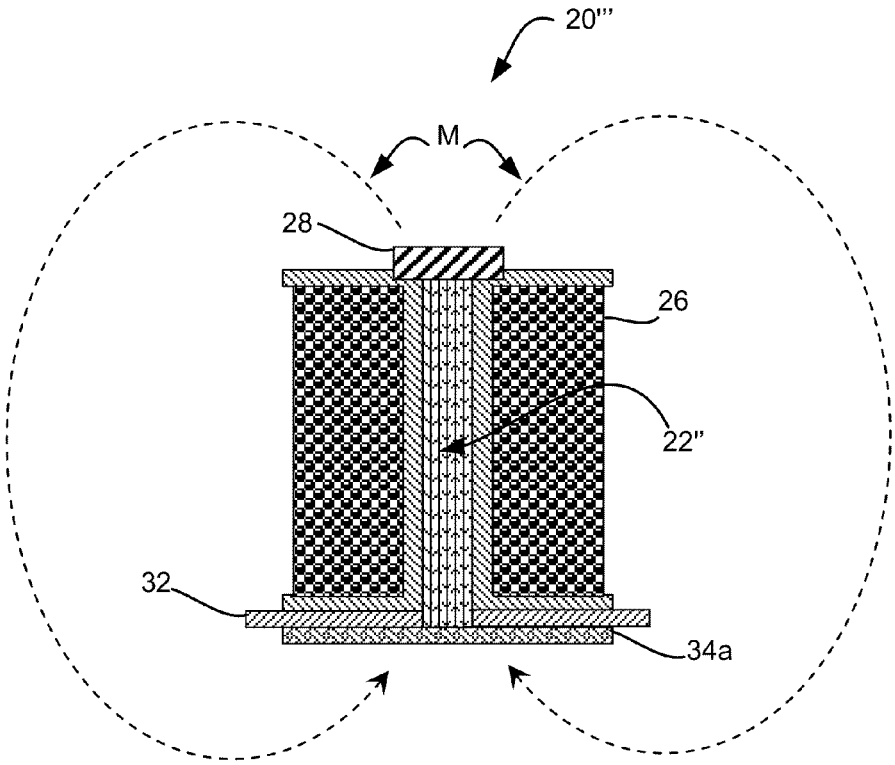
FIG. 4 shows the cross-section of a preferred coil-bobbin assembly with a pole piece cap and the interior of the coil filled with a laminated pole piece.
Figure 5:
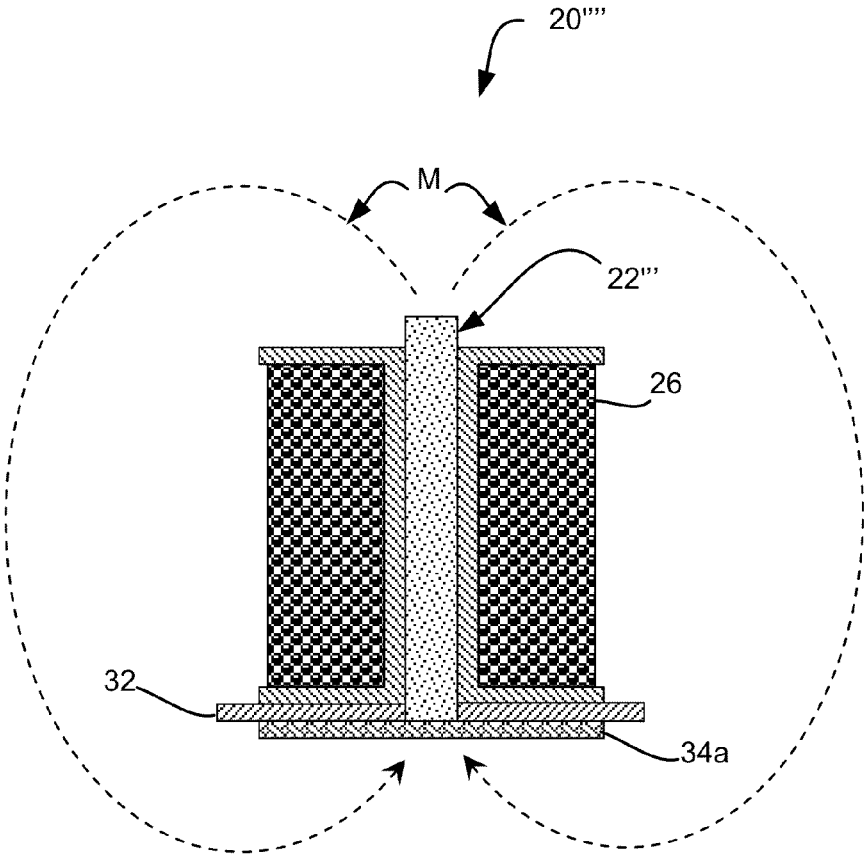
FIG. 5 shows the cross-section of a coil-bobbin assembly with the interior of the coil filled with a solid pole piece.

As noted above, pole piece caps 28*a*-28*f* may also perform a magnetic function, in that they extend the region of magnetic sensitivity associated with the coil/pole piece assembly further into the region of overlap between adjacent coil/pole piece assemblies. Especially in the case of adjacent pole pieces with opposite magnetic polarity, this is advantageous in maintaining a consistent and continuous sensitivity pattern in the region between adjacent coil/pole piece assemblies. Even when the containment aspect of the pole piece cap is not required, the magnetic aspect may be advantageous, and this is especially the case when AlNiCo is used as a pole piece. The pole piece cap may also be used partially, and in fact in a preferred embodiment, the pole piece cap is used only on coils 26*c*-26*d* on a pickup with AlNiCo pole pieces similar to the configuration illustrated in FIG. 2, in order to increase the sensitivity in the region between the magnetically opposed pole pieces 22*c*-22*d*.

In a preferred embodiment, the rectangular or stadium shaped coil wrapping/pole piece pairs are arranged such that a first portion of the adjacent, sequential pairs are arranged on a first line $l_1$ and a second portion, representing the remainder of the adjacent sequential pairs, are arranged on a second line $l_2$, as illustrated in FIG. 1. In this manner the spacing, in the direction perpendicular to the longitudinal axis of the string, between the adjacent pole piece pairs representing the last of the pairs associated with the first line, and the first of the pairs associated with the second line can be minimized. As can be seen by a preferred embodiment illustrated in FIG. 1, where coil/pole piece pairs 1-3 are situated along first line $l_1$ and coil/pole piece pairs 4-6 are situated along second line $l_2$, a plane $p_1$ equidistant between strings 24*c*-24*d*, parallel to the longitudinal axis of the string and perpendicular to the string plane, bisects the interiors 22*c*-22*d* of the coil wire wrappings 26*c*-26*d* of the adjacent coil/pole piece pairs. This arrangement provides for the maximum allowable overlap between the adjacent pairs while maintaining all of the coil/pole piece pairs within an allowable design footprint, especially as in the case where the pickup is configured for hum cancelling operation and coil/pole piece pairs 1-3 and 4-6 respectively are configured with opposite magnetic orientations.

The preferred construction of pickups representing the preferred embodiments disclosed herein will be described below. It should also be noted, however, that, optionally, the techniques described in any one or more of U.S. Provisional Patent Application 60/923,607, U.S. Provisional Patent Application 60/995,610, U.S. Provisional Patent Application 61/194,597, U.S. Provisional Patent Application 61/209,071, U.S. Provisional Patent Application 61/402,527, U.S. patent application Ser. No. 12/104,121, U.S. Pat. No. 7,989,690 and U.S. Pat. No. 7,612,282 can also be applied.

Generally speaking, the various pickups disclosed herein consist of the same basic parts: top and bottom flatwork 30-32 (if applicable); coils 26*a*-26*f* of predefined shape, dimensions, wire type and number of windings; at least one permanent magnet 34 (if applicable) of predefined shape, dimensions and composition, and magnetically permeable screws, slugs, rectangular plate pole pieces, a plurality of thin sheets or a laminate (if applicable) 22*a*-22*f*. The top and bottom flatwork 30-32 will generally contain the appropriate pattern of holes or slots (as required) to accept the pole piece for that design. Flatwork 30-32 may also incorporate a pattern of metallic eyelets or interconnects to enable the connection of the individual coils. Flatwork 30-32 can be formed of various materials including vulcanized fiber or FR4 reinforced fiberglass (such as commonly used for printed circuit boards). A printed circuit board is especially advantageous, as it can provide mechanical support and a means for accepting the pole piece as well as a connection point for the individual coils, interconnects between the coils and a means for connection to an external device. It is well within the ordinary skill in the art to devise a circuit board design(s) to satisfy these requirements in light of the disclosure herein.

One representative example, of a design that approximates the dimensions of a single coil Stratocaster® style pickup, follows. The six rectangular pole pieces can be fabricated from AlNiCo V material with a height of approximately 0.800" a length of 0.460" and a thickness of 0.062". The pole pieces should be magnetized along the height axis. The face of the pole piece (perpendicular to the height axis) can be in the shape of a stadium such that the radius of the semicircular end caps of the stadium is about 1/32". The acute angle of the coil/pole piece pair with respect to the axis of the string (the angle a in FIG. 1) may be set to 45°. The coils can either be wound directly on the pole pieces, constructed as self supporting coils, or wound on a bobbin. A coil wound on a bobbin will be described here. The coils can be constructed from a range of wire gauges, #43 polybond copper wire or equivalent will be described here.

A coil with a stadium cross section, as illustrated in the Figures, should be constructed. The inner core of the bobbin should be sized to accept the stadium cross-section pole piece described above. The wall thickness of the bobbin inner core should be minimized. The top and bottom flanges of the bobbin will conform to the stadium cross section of the pole piece with a length of about 0.69" and a width of about 0.285". The thickness of the top and bottom flanges of the bobbin should be minimized. The overall height of the bobbin is adjustable, but a height of 0.60" will be used for this example. Within these dimensions, a coil composing about 8500 turns of #43 polybond wire can be obtained. It should be noted that a range of coil winding configurations, and even sizes, may be used and in fact incorporated in a single pickup. In fact it may be beneficial to adjust the coil winding specifications as a function of string position in order to obtain a balanced output. For instance, the winding levels of the D and G strings may be increased relative to the adjacent strings to account for the relatively lower magnetic field in the vicinity of the magnetically opposed D and G pole pieces. A bottom flatwork of width 0.95", 3.27" and thickness 0.062" should be slotted to accept the pole pieces at an angle of 45° with respect to the length and a spacing of 0.414" along the width. The first set of three slots, accepting the pole pieces corresponding to the high E, B and G strings on the guitar, will be centered along a first line parallel to the length axis. Similarly, the second set of three slots, accepting the pole pieces corresponding to the low E, A and D strings on the guitar, will be centered along a second line parallel to the length axis of the flatwork. These first and second lines will preferably be displaced from each other in the direction of the width axis of the flatwork by 0.052". The spacing along the length axis of the flatwork between the slot corresponding to the G string from the first set of three and the slot corresponding to the D string from the second set of three is reduced to 0.360" from the 0.414" between the other slots. The slots should be centered overall with respect to both length and width of the flatwork. The bottom flatwork may be drilled and fitted with brass eyelets (such as commonly used in pickup construction) to allow for interconnection of the individual coils, and also connection of lead wires. A top flatwork is not required provided the top flange of the bobbin is robust. Alternatively, the bottom flatwork can be constructed as a printed circuit board. The pole pieces are first press fit into the bottom flatwork.

The individual coils may then be slipped over the pole pieces and the lead wires for the individual coils are threaded through the appropriate eyelets or, in the case of a circuit board flatwork bobbins can be connected via surface or through-hole mounting. The coils can then be attached to the bottom flatwork with any of a number of commonly available epoxies, caulks or adhesives. If appropriate, plate magnets can be attached to the bottom surface of the flatwork. Care should be taken to position the magnets with the correct magnetic orientation and centered about their associated pole pieces. Lead wires can then be attached to allow for connection of the pickup to a guitar control assembly.

Some preferred orientations of the proposed embodiments are illustrated in FIGS. 1-5. The preferred embodiments of FIGS. 1-4 may incorporate both magnets and, if desired, pole piece caps, that substantially conform to the dimensions and boundaries of the coils with which they are associated. In this way, the respective magnetic fields are focused on, compatible with and symmetric about the coils with which they are associated. In the preferred embodiments illustrated in FIGS. 2, 3, 4 & 5, the bottom plate magnet is preferably formed of a Neodymium-Iron-Boron alloy. Such so called "Neo" magnets are preferred for their high magnetic strength and stability allowing for the achievement of the required magnetic properties in the smallest space.

Turning now to FIG. 6-18 and the preferred modeling aspects of the present invention, the invention also provides a system/model whereby tonal characteristics may be predicted and varied over a wide range. As discussed below, by selecting various parameters, desired inductive properties and frequency responses may be obtained over a wide range of tonal and output characteristics. The various parameters may include wire gauge and number of windings, coil geometry and layout, magnetic geometry, magnet composition and strength, and especially the composition, dimensions and geometry of the magnetically permeable material filling the unwound interior of the coil. Thus, using the model described below, inventive pickups may be designed to substantially emulate the tonal and output characteristics of traditional pickup designs, or they may be designed to provide unique characteristics. It will be demonstrated how the inductive and frequency response of various materials and configurations may be characterized and correlated, and how these characterizations may be utilized to identify novel pole piece materials and/or configurations and construct preferred examples of the embodiments.

The response of an electric guitar pickup may be considered as a narrow band pass filter, with the passband corresponding to the resonant frequency, and various pickups may exhibit widely varying frequency responses in absolute terms. The fact that the passband of each pickup may vary greatly from other pickups makes it difficult to compare pickup data directly and draw reasonable conclusions about relative performance and trends. In accordance with the invention, this problem is solved by considering the response of various pickups or pickup components on a normalized basis instead of on an absolute basis. This enables a much better comparison because the responses of pickups of similar design and tonal characteristics, when plotted, clearly visually cluster into groups and differentiation between pickups of various types is enhanced. A primary differentiating factor of pickup tonal response in this analysis is revealed as not the absolute value of the resonance frequency, DC resistance, inductance or any other electrical measure, but the shape of the normalized frequency response curve. Once this has been done, a peak width parameter, analogous to a bandwidth in standard electrical engineering practice, may be defined and used to quantify the shape of the curve. Even further, the phase angle response in the vicinity of resonance is closely coupled with the peak width, but a much more sensitive and accurate measure of the shape of the frequency response.

It has been newly determined that the behavior of both soft and hard magnetic materials in a pickup can be quantitatively measured, characterized and correlated in a way that allows for specific tonal characteristics to be targeted and for the tonal performance of novel materials to be predicted. The method involves determining the gain and phase angle as a function of normalized frequency for a given pole piece in a single, isolated, reference coil. Preferably, the single reference coil represents one of the six coils that are typically used to construct a full pickup of the preferred embodiments. Other electromagnetic characteristics, and most specifically the inductance, are also determined. The resonant frequency and inductance of the pole piece in the reference coil can then be normalized with respect to the "empty" reference coil, i.e. the electromagnetic measurements of the coil only with no pole piece residing in the hollow core. In this manner, a relative response of the pole piece material is obtained and can be compared to an idealized inductive response. This inventive model can be used for the purpose of designing and targeting pickup performance, and specifically for identifying materials that mimic a desired response or materials that achieve a response unobtainable with traditional materials.

Using normalized frequency response curves as noted above, the range of response of pole piece materials in a reference coil may be qualitatively compared to the range of response of conventional pickups. It is important to note, however, that the preferred relative pole piece response may only be measured in the single, isolated, reference coil. When more than one pole piece is placed in the interior of a coil, or when more than one coil is utilized (such as is the case in the majority of conventional pickups), mutual inductance between the respective coils and pole pieces convolute the response such that comparison to an idealized inductor is no longer valid. For example, attempts to measure the relative frequency and inductive response of carbon steel or iron "slug" pole pieces in a conventional humbucker coil yield results that vary widely from the results when similar materials are measured in an isolated reference coil, especially in terms of the value of the exponent alpha.

Using the relative electromagnetic responses as noted above, it has also been newly determined that a range of tonal response may also be obtained by designing pickups with laminated metal pole pieces. The tonal response of pickups designed in this manner is a strong function of both lamina thickness and composition, as shown below. Preferred embodiments of the inventive pickups designed in this manner can be targeted to almost exactly mimic the tonal response of pickups constructed with non-laminated AlNiCo magnets. This is highly desirable, as it enables the design of a range of targeted pickup tonalities that are similar to those of traditional pickups, while also being highly flexible and reproducible.

Figure 6:
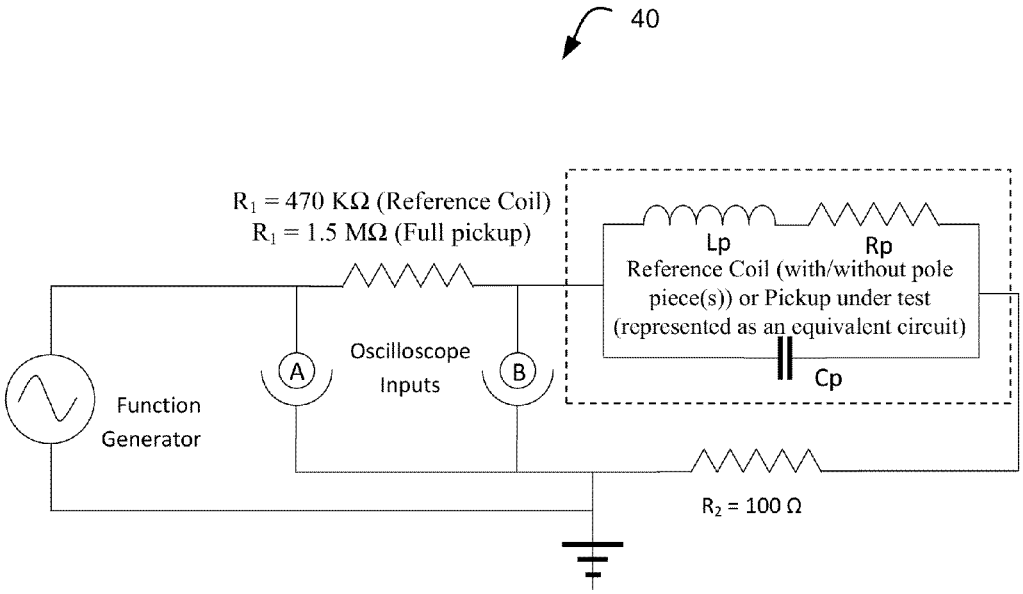
FIG. 6 is a schematic representation of a component and/or pickup measurement and test apparatus.

FIG. 6 is a schematic representation of the measurement and test apparatus 40 to collect gain and phase angle data as a function of frequency. With exceptions/developments noted below, a substantially similar system was used by both Helmuth E.W. Lemme, and Prof. Steven Errede at the Univ. of Illinois and is also employed in the present invention. A suitable digital oscilloscope is the Circuit Gear CGR-101 digital oscilloscope and a suitable function generator (not shown) is the network analyzer from Syscomp Electronic Design, Ltd. Appropriate selection of the resistor, $R_1$, in FIG. 6 is important to obtain accurate data regarding the shape of both the gain and phase angle response. This is especially true in obtaining response data close to resonance. A value of 1.5 MΩ was selected, as was also used by Errede, for full pickups with DC resistance in the range of about 5 to about 20 KΩ. The inventor has newly determined, however, that higher values of $R_1$ yield improved resolution of the frequency response at the expense of signal to noise ratio. It must be noted that different measurement systems and arrangements, both in terms of set up and instrumentation, could affect the values of some of the electrical and derived parameters discussed herein. Further, it may also be necessary to calibrate the respective measurement systems with the system taught by the inventor in order to obtain an appropriate comparison. In all cases, test apparatus 40 of FIG. 6 should be the benchmark by which pickups and materials are compared.

As discussed above, one aspect of this invention entails analysis of and comparison to a "reference coil. The reference coil, being isolated from other sources of inductance, provides an idealized geometry that allows for the direct measurement and identification of the contribution of the pole piece to the electromagnetic characteristics of the pickup, in the absence of convoluting effects arising from the mutual inductive and capacitive coupling that are always present when multiple pole pieces and/or coils are utilized. Preferably the cross section of the reference coil will approximate the shape of the pole piece. Most preferably, the reference coil will represent one coil of the plurality of coils that are incorporated into an assembled pickup. The most preferred reference coil is wound on a bobbin of stadium cross section with a length of 0.481", width of 0.094" and a height of 0.590". The reference coil is wound with 8000 turns of #43 awg polybond wire. This coil exhibits a DC resistance of about 2050Ω. With respect to FIG. 6 it has been determined by the inventor that a lower value of $R_1$ of about 470 KΩ is more appropriate to obtain reasonable signal to noise ratio when measuring reference coils, which tend to have a resistance value on the order of ⅙ of the value of a full pickup.

Figure 7:
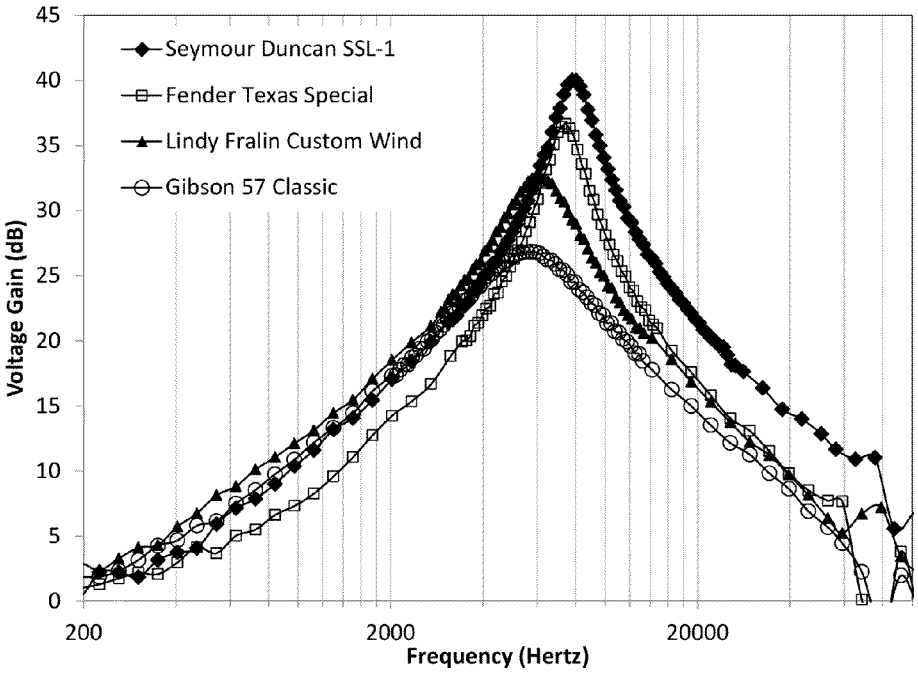
PRIOR ART Figure 7
FIG. 7 illustrates the gain response as a function of frequency for a variety of commercially available traditional pickups.

FIG. 7 illustrates gain as a function of frequency for a range of commercially available pickups. Some trends in the data from FIG. 7 may be detected by careful inspection, but it is difficult to compare the responses of pickups on a direct quantitative basis using the raw data. In the data presented here, the relative voltage gain for each data set has been adjusted such that the baseline gain (gain between 1 and 50 Hz) is nominally zero.

Figure 8A:
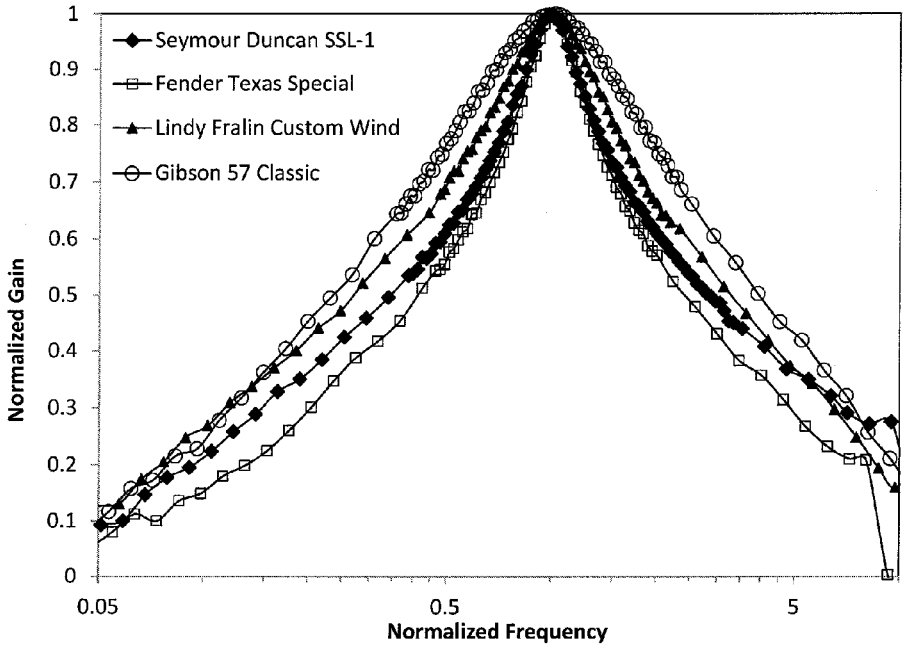
FIGS. 8*a* and 8*b* illustrate phase angle and normalized gain as a function of normalized frequency for a variety of commercially available traditional pickups.
Figure 8B:
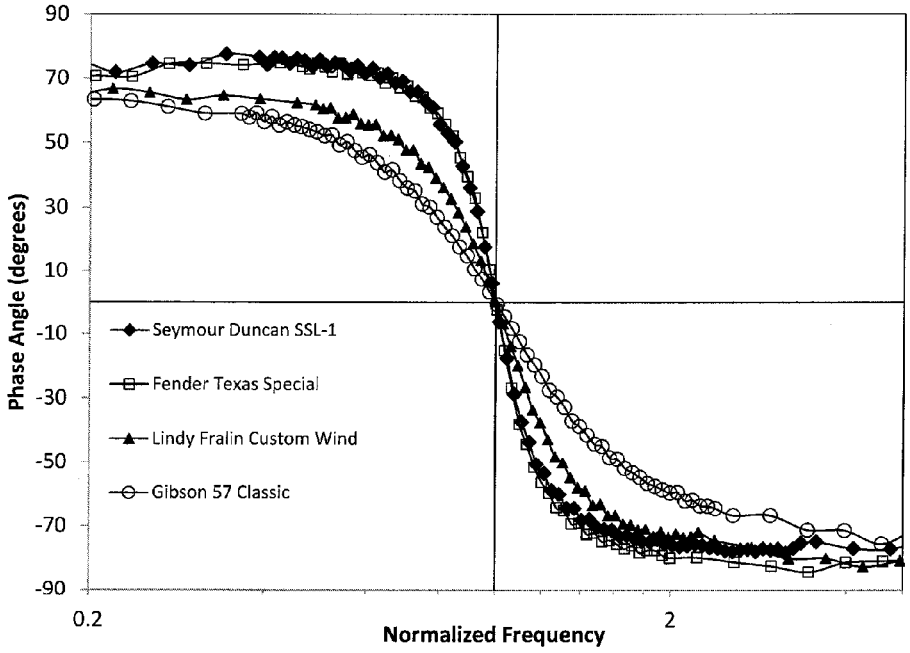

FIG. 8 illustrates the data from FIG. 7 as well as the phase angle, on a normalized frequency basis. A resonant frequency can be defined as the frequency at which the gain is a maximum or the frequency at which the phase angle passes through zero. In FIG. 8, the frequency scale for each pickup is normalized with respect to the resonant frequency for the individual pickup such that:

$$\omega_n = \frac{\omega}{\omega_r} \tag{1}$$

where $\omega_n$, is defined as the normalized frequency for any frequency ωw, and $\omega_r$ is defined as the resonant frequency for the device under test or consideration. The gain response is normalized linearly between 0 and 1, with zero generally defined as the mean gain between 1 and 50 Hz (the baseline gain) and 1 as the maximum gain for each data set. Note that the absolute value of the baseline gain is a function of the value of $R_1$ as shown in FIG. 6 and the DC or low frequency AC resistance of the device. The value of the phase angle is preferably not normalized. The efficacy of this approach can immediately be observed in the differentiation between the various types of pickups. The gain response of the single coil Stratocaster® type pickups (Fender® and Duncan® SSL-1) are clustered at narrower width and exhibit a concave profile. The gain peak for the humbucker type pickups is typically wider and less concave as in the Gibson® and Fralin® examples shown here. However, it has been determined that some humbuckers exhibit intermediate behavior as in the Duncan® JB bridge and Duncan® 59 PAF (not shown). Similar trends can be observed in the phase angle response with the Stratocaster® type pickups exhibiting a higher maximum to minimum range of phase angle and a steeper slope of the phase angle with respect to normalized frequency in the vicinity of the resonance frequency (unity normalized frequency). The "fatter" Gibson® and Fralin® humbuckers are at the opposite end of the spectrum and exhibit a shallower slope of the phase angle with respect to normalized frequency at resonance.

In accordance with certain aspects of the invention, the test apparatus 40 of FIG. 6 was used to deduce material characteristics that may be used to predictably design new pickups. For example, a reference coil of the dimensions and specifications detailed earlier was used to characterize a range of materials as pole pieces. Although not necessarily required to perform the tests discussed herein, all materials consisted of coupons of nominal length of 0.375" and height 0.75" corresponding to the length and height of the preferred coil respectively. The width or thickness of the coupons was variable, between about zero and 1/16", so that the effect of changes in thickness could be deduced.

Figure 9A:
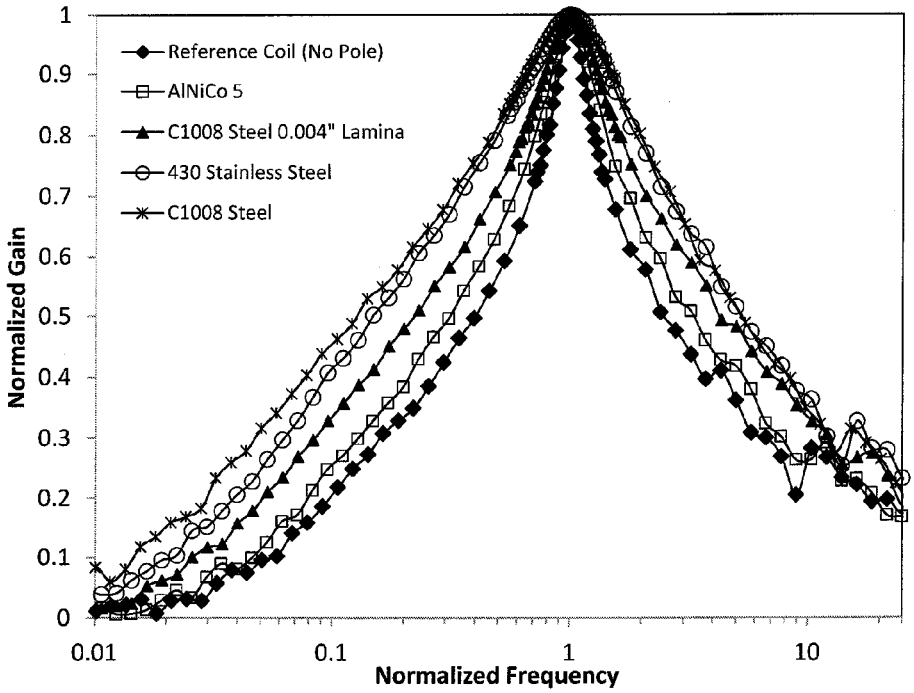
FIGS. 9*a* and 9*b* illustrate phase angle and normalized gain as a function of normalized frequency for a range of pole piece materials in a preferred reference stadium coil.
Figure 9B:
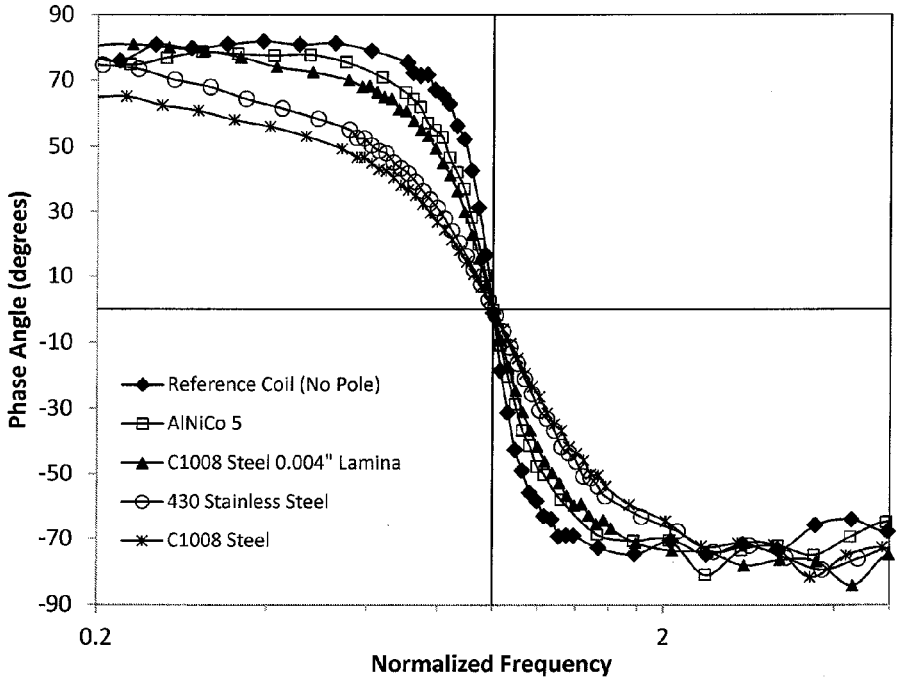

A typical bobbin core compatible with the dimensions of the reference coil and of the type shown in FIGS. 1-5 above can accept a sample up to about 1/16" of an inch nominal width. FIG. 9 illustrates the phase angle and normalized gain response for a range of materials in the reference coil as a function of normalized frequency. All of the materials in this example had a nominal thickness of about 0.062", with the exception of the C1008 low carbon steel which consisted of eight individual lamina with a thickness of about 0.004" each, resulting in a total thickness of about 0.032". Unless otherwise noted, all of the soft magnetic material data reported herein were obtained with the test pole piece in a magnetic field, oriented according to FIGS. 4 and 5 (excepting that only a single, isolated coil was present) and having a strength typically utilized in a pickup. For example a Neo magnet of composition N35 with nominal dimensions of 1.46"×0.56" and a thickness of 0.062" may be used. As in the case of the commercial pickups whose normalized responses are illustrated in FIG. 8, the relative response trends between the various materials are readily apparent in FIG. 9. The reference coil itself, with air filling the core of the bobbin, exhibits the most narrow peak of normalized gain with respect to normalized frequency, and also the most concave, with the concavity defined with respect to the curvature of the gain versus frequency response between the baseline (or "zero") level and resonance. The AlNICo 5 pole piece causes a slight broadening of the peak followed by, in order of increasing width, the laminated C1008 steel, 430 stainless steel, C1008 steel and the CMI-B iron. Note the similarity in the range of response between the commercially available pickups illustrated in FIG. 8 and the pole piece materials illustrated in FIG. 9. In accordance with the invention, it has been deduced that these data imply that a full range of tonal characteristics can be obtained by changing the pole piece material in a fixed coil configuration. As shown below, these data can be quantified, correlated and leveraged to target specific tonal characteristics. Also in accordance with the invention it has been observed that the relative shapes of the frequency responses in FIG. 8 relate to the tonal characteristics of the respective pickups.

For instance, consider the comparison between the reference coil alone and the AlNiCo 5 pole piece illustrated in FIG. 9. The AlNiCo 5 pole piece contributes to only a very slight broadening of the gain response and softening of the phase angle response, maintaining most of the characteristic frequency response of the coil alone. Similarly, traditional Stratocaster® pickups utilizing AlNiCo pole pieces are commonly and colloquially described by guitar players as "thin", and "transparent". When plotted in accordance with the invention, the AlNiCo pole piece exhibits a relatively narrow gain response and a less significant deviation from the intrinsic characteristics of the reference coil with no pole. By contrast, the C1008 steel exhibits the most significant deviation from the intrinsic coil response and this is analogous to the response of the Gibson® and Lindy Fralin pickups illustrated in FIG. 8. Humbucking pickups are typically and colloquially described as "heavy" or "fat", consistent with their relative frequency response, and also use low carbon steel or iron screws and slugs as pole pieces as well as additional iron or steel in the support structure.

Strong parallels can be qualitatively deduced between the material driven responses illustrated in FIG. 9 and the relative signatures of the commercial pickups illustrated in FIG. 8. However, a more quantitative understanding of the material design space is helpful to facilitate more accurate performance targeting. Also while an important piece of the picture, the frequency dependent response of the pickup is not alone a complete descriptor of behavior.

DC resistance has been widely used to characterize pickup output and tonal response. While DC resistance can be a useful metric when comparing different pickups of the same design, and especially using similar pole piece materials, the data from FIG. 9 represent a 2× range in resonant frequency and more than a 5× range in inductance with negligible change in DC resistance. This comparison highlights the inadequacy of DC resistance alone as a performance metric and the need for more comprehensive measures (such as those presented by the invention) capable of differentiating between designs and materials.

Figure 10:
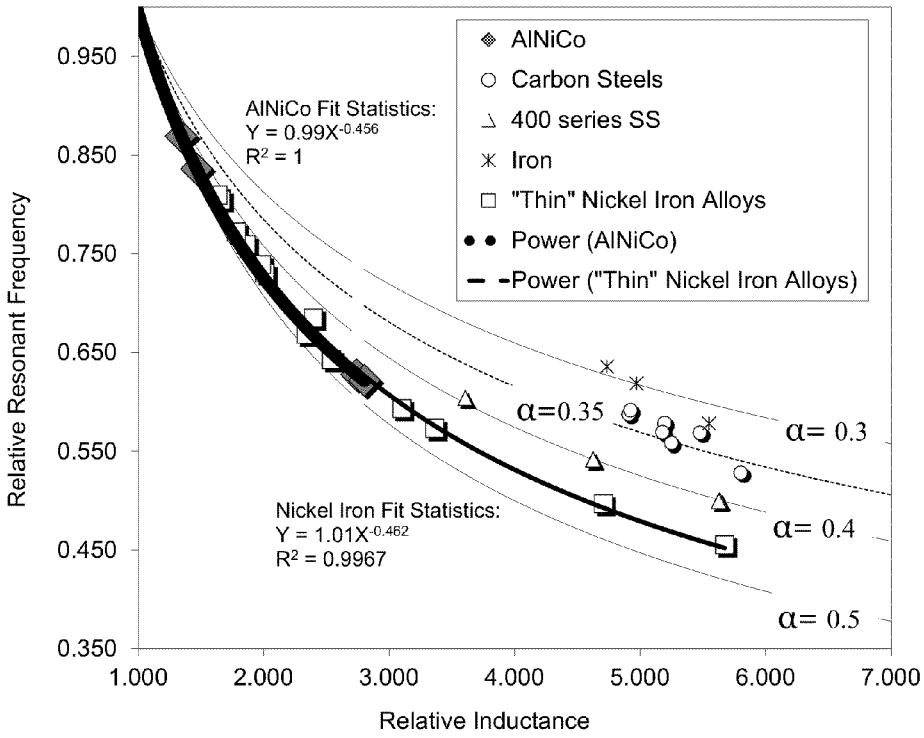
FIG. 10 shows relative resonant frequency as a function of relative inductance for a range of pole piece materials in a preferred reference stadium coil.

A traditional guitar pickup may be modeled as an RLC band pass circuit. The resonant frequency response of an ideal inductance in an RLC circuit can be described according to the relationship:

$$\omega_r = \frac{1}{\sqrt{LC}} \tag{2}$$

Where $\omega_r$ is the resonant frequency, L is the inductance and C is the capacitance. FIG. 10 shows relative resonant frequency as a function of relative inductance for a range of pole piece materials in the reference stadium coil. Inductance was measured at 1000 Hz with an Extech model 380193 LCR meter using a series model. In FIG. 10 both the resonant frequency and inductance are normalized with respect to the reference coil alone with no pole. Thus, a relative resonant frequency and relative inductance can be defined as:

$$\omega_{r\text{-}rel} = \frac{\omega_{r\text{-}test}}{\omega_{r\text{-}ref}} \tag{3}$$

$$L_{r\text{-}rel} = \frac{L_{r\text{-}test}}{L_{r\text{-}ref}} \tag{4}$$

where $\omega_{r\text{-}rel}$ is defined as the relative resonant frequency for the material or pole piece under test or consideration, $\omega_{r\text{-}test}$ is the measured resonant frequency for the material or pole piece under test or consideration when placed in the reference coil, and $\omega_{r\text{-}ref}$ is the measured resonant frequency for the reference coil itself with no pole piece in place. The L parameters are similarly defined. Note that $\omega_{r\text{-}rel}$ is always less than or equal to unity, while $L_{r\text{-}rel}$ is always greater than or equal to unity. Also note that the point corresponding to ($\omega_{r\text{-}rel}$=1, $L_{r\text{-}rel}$=1) corresponds to the measured value of the isolated reference coil alone, with no pole piece installed. The solid line in FIG. 10 represents the response of an ideal inductance with ω proportional to the inverse square root of L ($L^{-0.5}$) as per Equation 2 (note that since the ideal parallel capacitance of the coil itself is constant whether a pole piece is present or not, it can be removed from the equation). While some of the materials approach ideal inductive behavior, the response of the various materials can be represented in a more general form:

$$\omega_{r\text{-}rel,n} = L_{r\text{-}rel,n}^{-\alpha} \tag{5}$$

where the subscript "r-rel,n" denotes the relative value of inductance and resonant frequency for a given material type, "n", and "α" is an exponent modeling the departure of the pole piece response from ideality with α=0.5 representing ideal inductive behavior. Note that the exponent alpha can be determined by the position of a data point or data series on a plot of relative resonant frequency versus relative inductance, or can be calculated as:

$$\alpha = -\log_{L_{r\text{-}rel,n}}(\omega_{r\text{-}rel,n}) \tag{6}$$

Note that in this derivation, the units of frequency have not been specified and the multiplier, 2π, which allows for conversion between radians and cycles per second has been omitted. This is acceptable because (where frequency is considered as a function of inductance, or vice versa) the values of each parameter are normalized (or as defined herein, relative) such that the multiplier would cancel.

The modeling approach illustrated in FIG. 10 allows for significant differentiation between the behavior of the various pole piece materials. Note that the "humbucker-like" materials, iron (obtained from CMI corporation) and the carbon steels (including grades 1008, 1020, 1075/1075, 1095 and 4130, obtained from McMaster-Carr), are clustered at high normalized inductance, low normalized resonant frequency and characterized by an a value on the order of 0.3. AlNiCo and other "Stratocaster®-like" materials (as will be shown) can be characterized by an α value much closer to 0.5, typically between about 0.45 and 0.48.

Some other material responses of note are evident in FIG. 10. The 400 series stainless steels are a novel material for use as a musical instrument pickup pole piece and exhibit some atypical behavior with both a frequency-inductance response and an alpha value intermediate between humbucker and Stratocaster®-like materials. These characteristics contribute to a unique tonal response (note the intermediate frequency response behavior also evident for the 430 stainless steel in FIG. 9) with this material. Also note the nearly ideal inductive response of the laminated Nickel-iron alloys (labeled "thin nickel-iron alloys" in FIG. 10, and available as CoNetic and Netic alloys from Magnetic Shield Corp). The data for these alloys represent the response obtained with multiple thicknesses of 0.004" thick layers laminated into a pole piece. Laminations of 2, 4, 6, 8, 10 and 12 layers are shown for the CoNetic material and 2, 4, 6, 8 and 10 layers for the Netic material. The points at higher relative frequency and lower relative inductance represent the thinner laminates in the series. An unconstrained power law fit to the AlNiCo data yields an equation that almost perfectly matches the form of equation 5, as does an unconstrained power law fit to the thin nickel-iron alloys data. In both cases, the pre-exponential factors are nearly exactly equal to one, and the $R^2$ values are over 0.99. These examples support that the inventive model proposed here is an excellent description of the electromagnetic signature of these materials.

Figure 11:
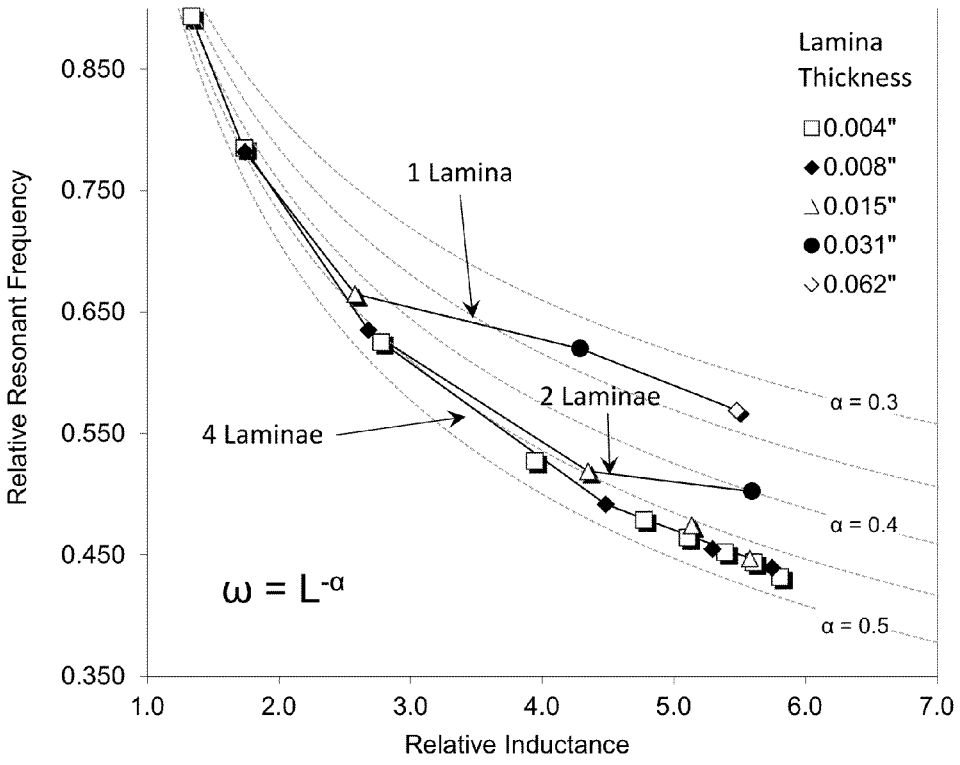
FIG. 11 shows relative resonant frequency as a function of relative inductance for a range of laminated pole pieces fabricated from low carbon steel in a preferred reference stadium coil.

FIG. 11 shows relative resonant frequency as a function of relative inductance illustrating the effect of lamina thickness on pole piece response. The data in FIG. 11 were generated using a range of lamina and total laminate thickness using the same specification low carbon steel material. Pole pieces were fabricated from C1008 shim steel, available from Precision Brand Company, in layer thicknesses of 0.004, 0.008, 0.015 and 0.031". A nominal 0.062" pole piece fabricated from C1008 low carbon steel sheet (purchased from McMaster-Carr Company) is also included. The data in FIG. 11 illustrate that a range of inductive/resonant behavior can be generated from the same material by using it in a laminated, instead of a solid, form. At low layer thicknesses, 0.004 and 0.008" in the FIG. 11, the inductive behavior approaches ideality, "ideality" defined as an alpha value of 0.5, with the 0.004 and 0.008" materials exhibiting an alpha value of about 0.47 at the highest normalized inductance. Note that these high normalized inductance values represent nominally 0.064" total thickness, 16 layers of the 0.004" and 8 layers of the 0.008" material respectively, presenting a significant shift from the bulk value of α=0.33 for the solid 0.062" sample. As the layer thickness increases, more significant deviations from ideal inductive behavior begin to occur. The 0.015" layer thickness exhibits a shift towards more non-ideal behavior, and the 0.031" sample at one layer thickness exhibits an alpha value similar to the 0.062" sample. Note that with two layers of 0.031" material, the alpha value is significantly reduced from the solid layer value for the same total thickness. From these data the most dramatic shift from more ideal to non-ideal behavior for both single layer and two layer samples occurs between the 0.015" and 0.031" layer thicknesses.

Figure 12:
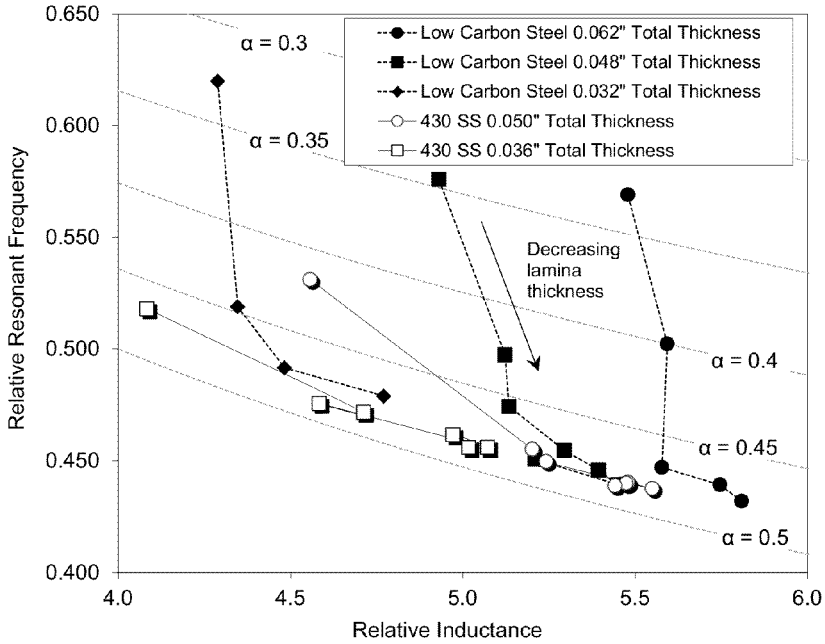
FIG. 12 relative resonant frequency as a function of relative inductance for a range of laminated pole pieces fabricated from low carbon steel and 430 stainless steel materials in a preferred reference stadium coil.

FIG. 12 shows relative resonant frequency as a function of relative inductance for laminates of 430 stainless steel and low carbon steel. The data in FIG. 12 were generated by measuring the inductance of a series of pole pieces targeted at a constant total laminate thickness constructed from individual lamina of varying thickness. As an example, the curve for low carbon steel at 0.062" thickness was constructed using 4 individual pole pieces consisting of 16 sheets of 0.004", 8 sheets of 0.008", 4 sheets of 0.015", 2 sheets of 0.031" and a single sheet of 0.062" laminae respectively. These data show clearly that laminates fabricated from 430 stainless steel are capable of achieving higher values of alpha compared to low carbon steel at similar lamina thickness, especially as the lamina thickness is increased. Also evident in FIG. 12 is the tendency for the alpha value to increase and saturate, at a level close to the ideal value of 0.5, as the lamina thickness is decreased. Note that in all of the curves representing a range of lamina thicknesses to achieve a nominal total laminate thickness, moving down and to the right (associated with decreasing lamina thickness) the value of alpha saturates and stabilizes at a level approaching 0.5.

Figure 13A:
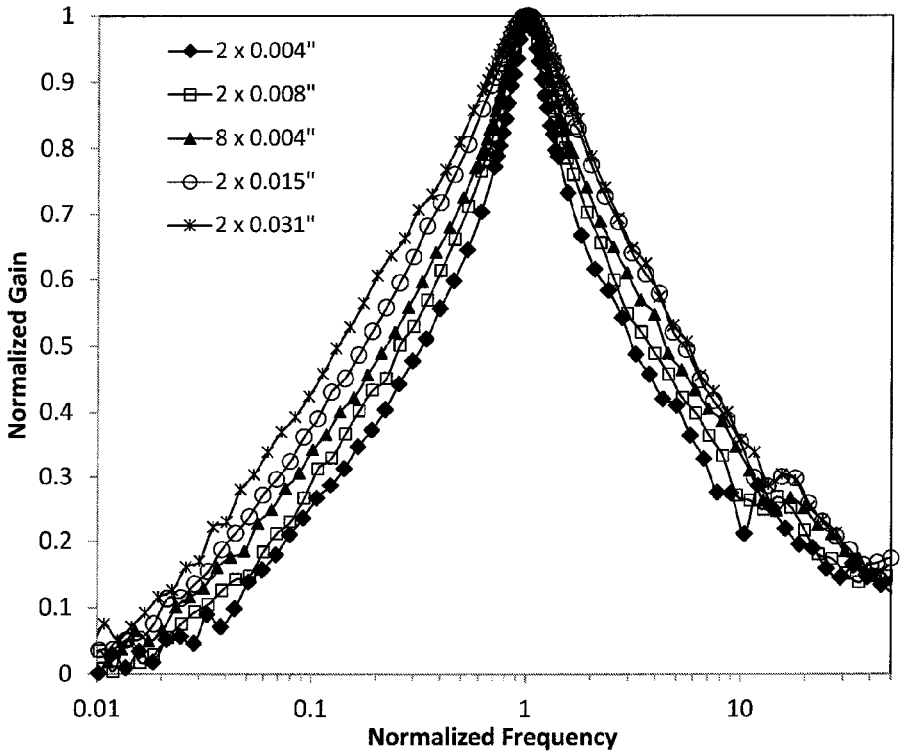
FIGS. 13*a* and 13*b* illustrate phase angle and normalized gain in a preferred reference coil as a function of normalized frequency for a range of laminates fabricated from C1008 low carbon steel.
Figure 13B:
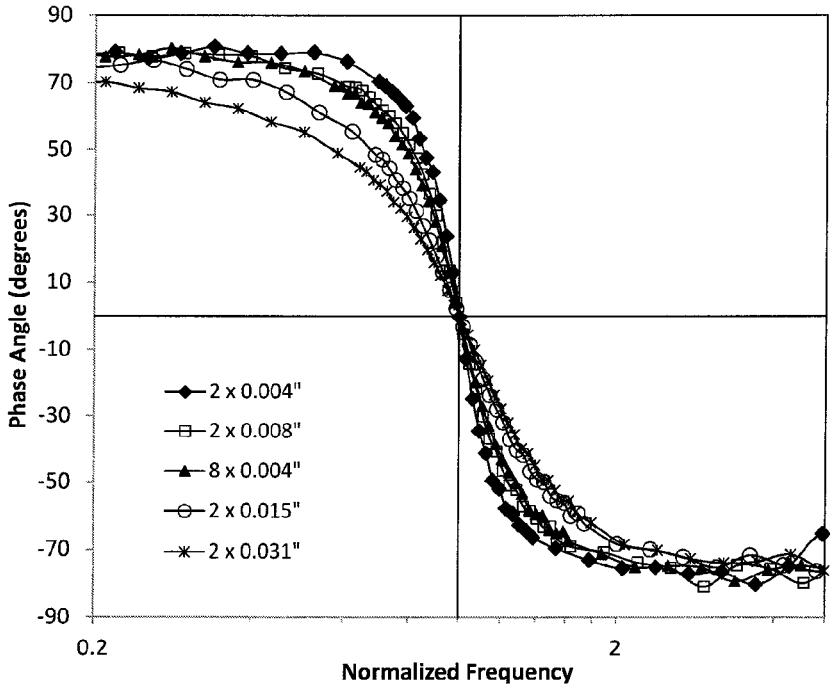

FIG. 13 illustrates how a single material composition, in this case C1008 steel, can be designed to cover a broad spectrum of gain/phase angle versus frequency response by using laminated layers in place of solid pole pieces. The range of frequency response exhibited in FIG. 13 is analogous to the range of response between typical hum-bucking and traditional Stratocaster® single coil pickups illustrated in FIG. 8, as well as the range of response of a range of materials in a reference coil in FIG. 9. This example serves to highlight the efficacy of the inventive approach described herein, in that the behavior of laminated pole pieces can be quantitatively targeted to achieve a wide range of tonal response in a non-intuitive manner.

Figure 14:
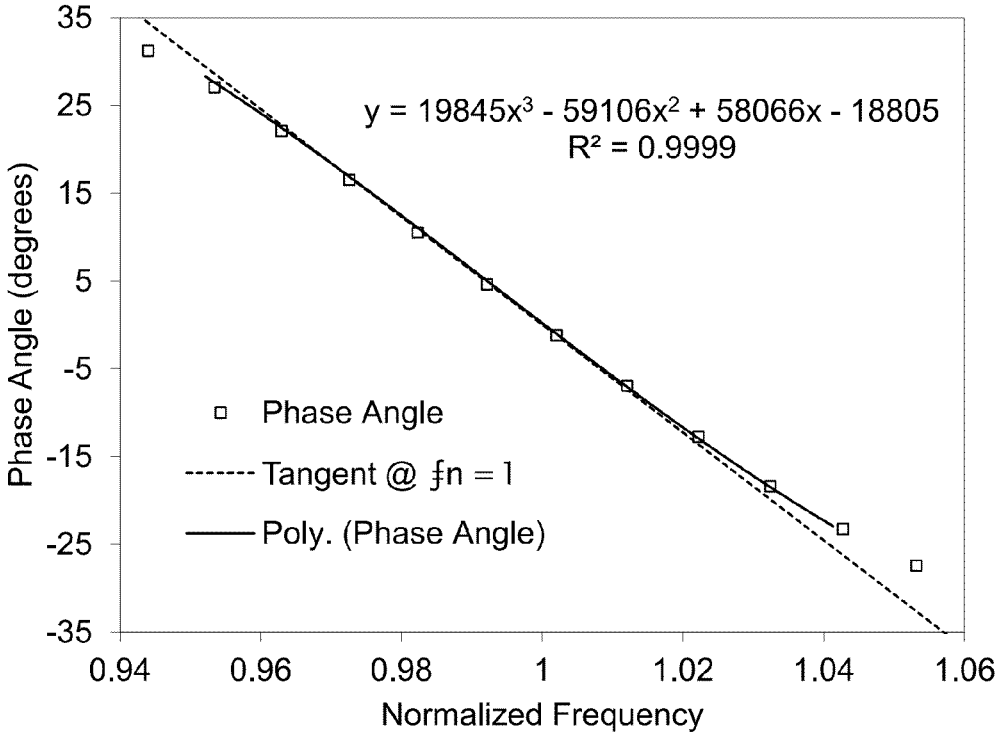
FIG. 14 illustrates phase angle as a function of normalized frequency, illustrating the tangent to the phase angle at the resonant frequency.

FIG. 14 illustrates the derivation of an additional inventive parameter that is efficacious in quantifying tonal performance. FIG. 14 shows the phase angle as a function of normalized frequency in the vicinity of resonance for the reference coil, with no pole installed, used for the generation of the data presented here. The slope of a tangent to the phase angle versus normalized frequency, taken in the vicinity of resonance (i.e. normalized frequency=1) provides a measure of the "shape" of the frequency response, especially as it pertains to the response at resonance. A qualitative inspection of the gain and phase angle responses in FIGS. 8, 9, 13, and 18 will reveal the strong correlation between the shape of the gain peak close to resonance and the slope of the phase angle versus normalized frequency at resonance. The absolute value of the slope of the phase angle response increases, i.e. the slope of the tangent to the phase angle becomes steeper and more negative, as the response of the gain peak close to resonance becomes sharper. A preferred method for calculating the slope of the tangent to the phase angle is also illustrated in FIG. 14. A third order polynomial is fit to the phase angle versus normalized frequency data between about 0.95 and 1.05 normalized frequency. As shown in FIG. 14, the quality of the fit to the data in this example is extremely high, with a regression coefficient, $R^2$, value of 0.9999. $R^2$ values of 1, indicating a virtually perfect fit, are regularly observed. As such, the third order polynomial fit provides an excellent representation of the phase behavior close to resonance. The slope of the tangent to the phase angle in the vicinity of resonance is calculated as the first derivative of the fitted phase angle versus resonance response. In this example:

$$y=19845x^3-59106x^2+58066x-18805 \quad (7)$$

and, $$y'=59535x^2-118212x+58066=-611 \ @\omega_n=1 \quad (8)$$

A range of methods could be employed to determine the phase angle including numerical interpolation, a linear fit, a second order or higher order fits, or other methods familiar to those versed in basic mathematics.

Figure 15A:
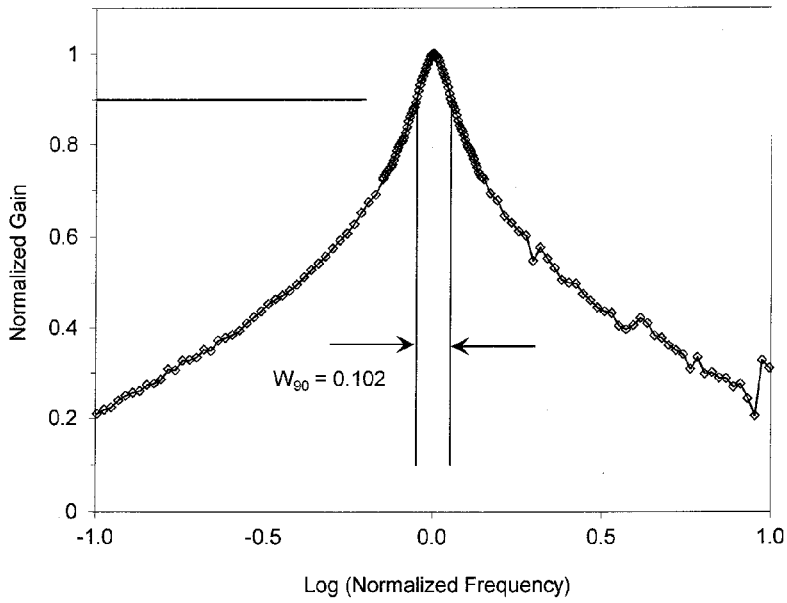
FIGS. 15*a* and 15*b* illustrate the definition of the 90% Normalized Peak Width and the correlation of 90% peak width to the slope of the tangent to the phase angle.
Figure 15B:
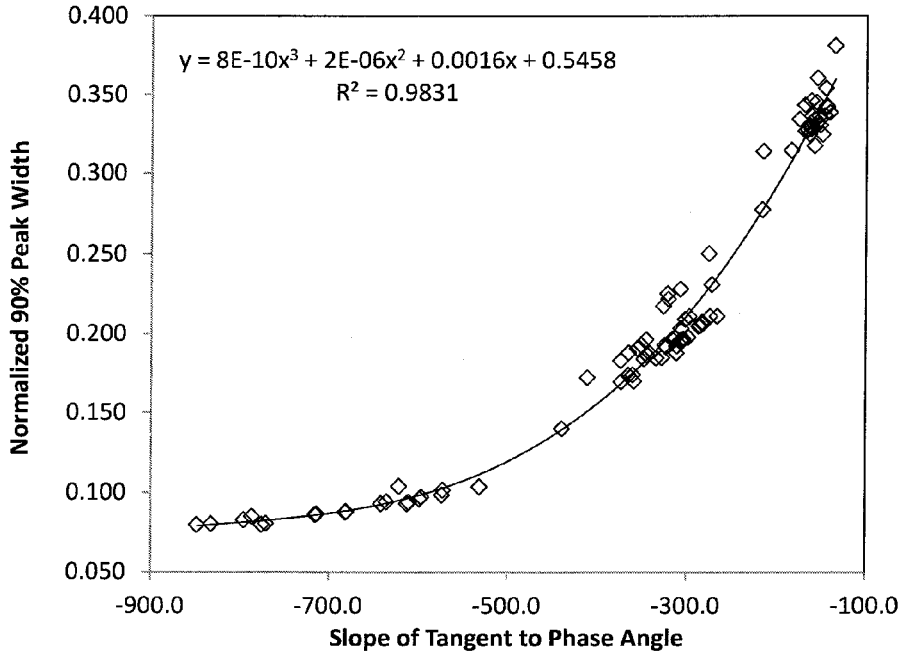

As mentioned above, the slope of the tangent to the phase angle at resonance is closely correlated to the shape of the gain response in the vicinity of resonance. FIG. 15 shows the definition of the 90% width of the gain versus resonant frequency peak. Note that the 90% peak width is taken based on the logarithm of the normalized frequency. FIG. 15 also illustrates a plot of the tangent to the phase angle at resonance against the 90% peak width for a range of pole piece materials, coil winding configurations and coil wire gauge. The correlation is very high, with an $R^2$ value of over 0.98. This implies that the 90% peak width could be used as a surrogate for the phase angle slope. In fact a number of parameters could be devised based on gain or phase angle response as a function of frequency. The slope of the phase angle versus normalized frequency at resonance, being more sensitive and consistent, is preferred and taught here for the first time.

FIG. 16 shows the slope of the tangent to the phase angle with frequency in the vicinity of resonance as well as the exponent alpha as a function of lamina thickness for a range of total laminate thicknesses for both low carbon steel, 430 stainless steel, Hiperco50 (available from Ed Fagan Inc.), AlNiCo 2 and AlNiCo 5. The effect of material composition as well as lamina thickness is evident in these data. In terms of the slope of the phase angle, pole piece materials trend towards a less negative value, approaching −150, as lamina thickness is increased to 0.062". 430 stainless steel maintains a more negative value of phase angle at higher lamina thickness compared to the low carbon steel, approaching the saturation value of −150 at about 0.050" thickness, whereas low carbon steel laminates approach the saturation value at lower thickness, about 0.031". Hiperco50, an iron-cobalt alloy available from Ed Fagan, appears to set up on a curve that would saturate in terms of the slope of the phase angle at an even higher thickness than 430 stainless steel, most likely at least 0.062" and possibly higher. AlNICo 2 and AlNiCo 5 can clearly be seen to be on curves that would saturate at thicknesses higher than 0.062". Unfortunately, more exotic materials like Hiperco 50 are not generally available in a range of thickness and the AlNiCo alloys are difficult or impossible to fabricate at low thickness, such that it is generally not possible to construct the entire curve for these materials. Still, the model presented here would allow for accurate prediction of the tonal performance of a wide range of novel and exotic materials, even though limited samples were available.

Figure 16A:
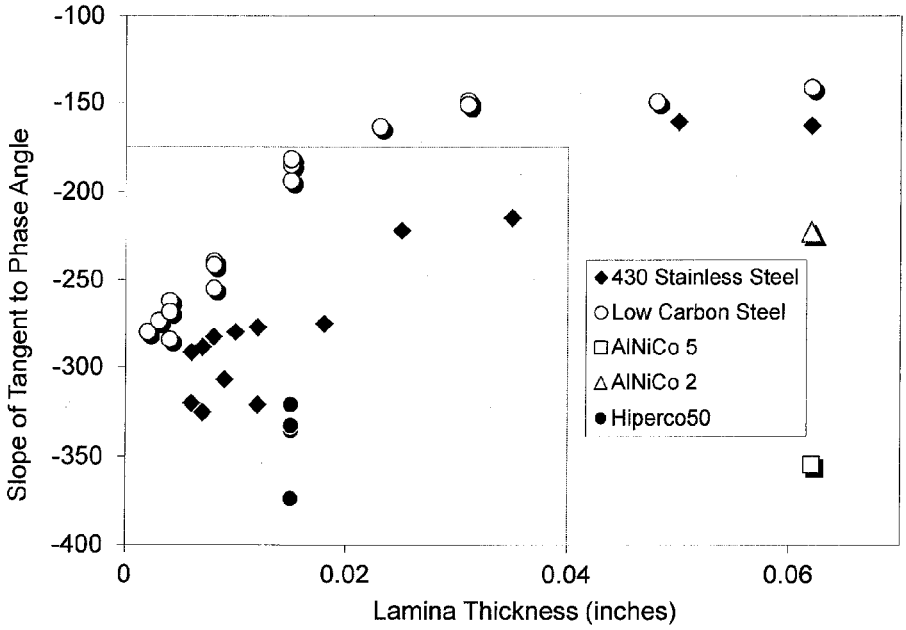
FIGS. 16*a* and 16*b* illustrate the slope of the tangent to the phase angle and the exponent alpha as a function of lamina thickness in a reference coil for a range of pole pieces fabricated from low carbon steel and 430 stainless steel.
Figure 16B:
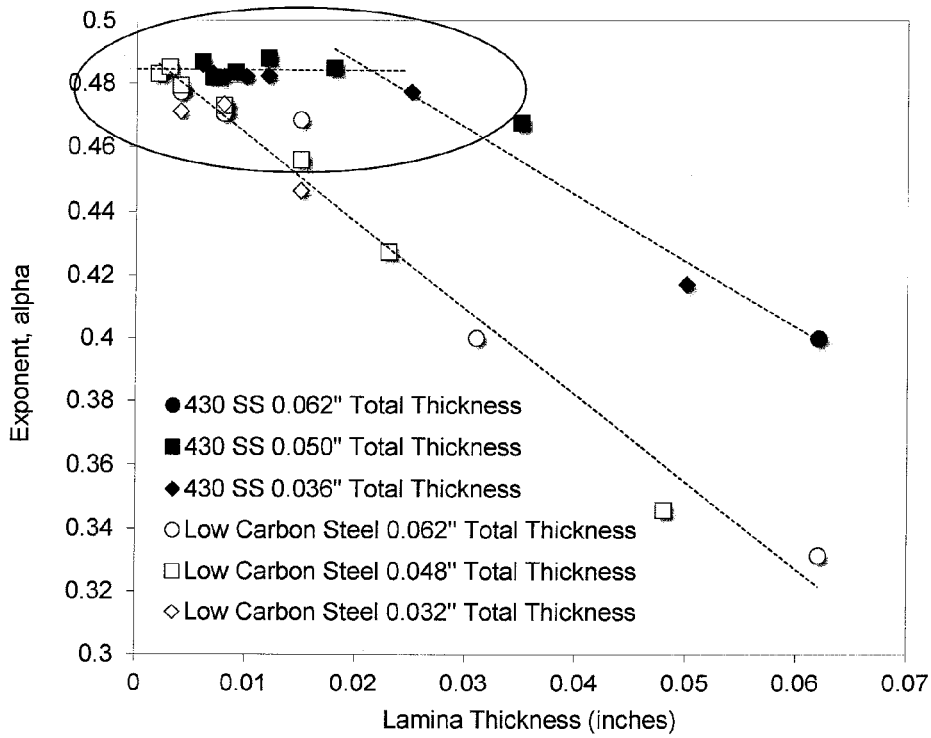

In terms of the exponent alpha shown in FIG. 16, pole piece materials trend towards ideality, approaching a value of 0.5, as lamina thickness is decreased. The 430 stainless material saturates at a value of about 0.48 at lamina thickness of around 0.025" and below. As used here, to "saturate" denotes that the value under consideration is a weak function of the parameter it is being plotted against. For instance, as seen in FIG. 16*b*, the exponent alpha for 430 stainless steel is a strong function of thickness for thicknesses above about 0.025" and is relatively constant below that value, so it can be said that the exponent alpha is substantially saturated for thickness below about 0.025" The low carbon steel does not appear to saturate, but increases monotonically with decreasing thickness, approaching a value of about 0.49, very close to the ideal value of 0.5, at a theoretical lamina thickness of zero.

The slope of the phase angle exhibits a dependence on total laminate thickness, which appears to become more significant as the saturation thickness of the material increases. This dependence can be seen as the range of slope values for any fixed lamina thickness in FIG. 16*a*, corresponding to 1, 2, 3, etc., sheets of material of a given thickness. Generally, the slope of the phase angle increases (becomes less negative) with increasing total laminate thickness at fixed individual lamina thickness. Note that low carbon steel exhibits minimal dependence on total thickness, while the Hiperco50 shows a broad range of slope at a fixed thickness of 0.015" (representing 1, 2 and 3 sheets of material, the 3 sheet data point exhibiting the least negative slope value), with the 430 stainless steel exhibiting an intermediate level of dependence. The exponent alpha exhibits less dependence on total thickness in these data, note that there is very little scatter around the dotted lines in FIG. 16*b*, decreasing more or less linearly with lamina thickness above some saturation value.

Figure 17:
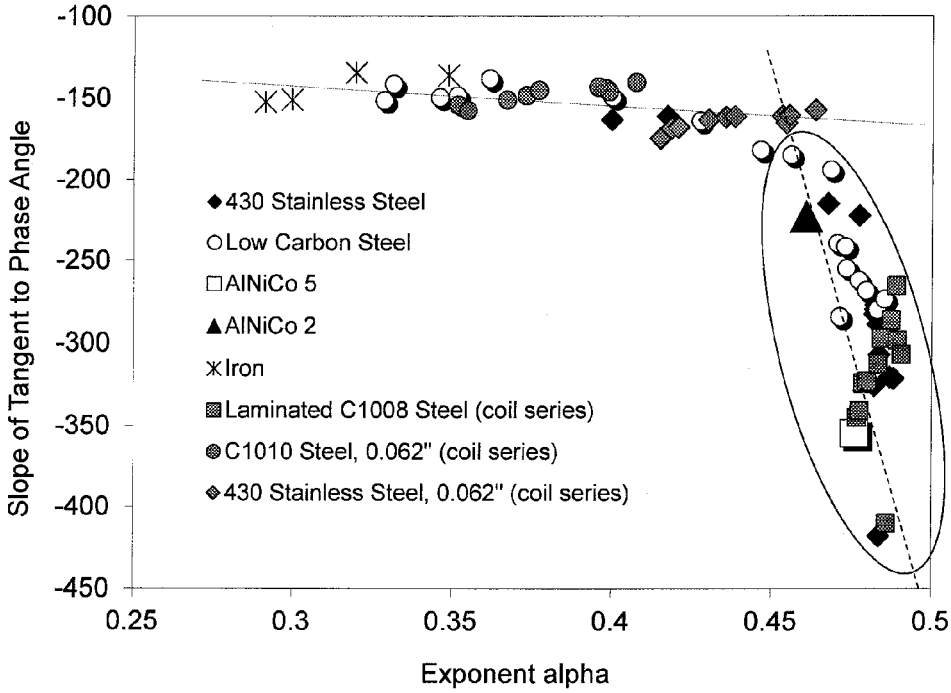
FIG. 17 shows the slope of the tangent to the phase angle plotted against the exponent alpha for a range of pole piece materials in a preferred reference coil, as well as a series of preferred reference pole pieces in a range of preferred coils.

The clearest format for identifying material responses for pickup design is illustrated in FIG. 17, where the slope of the phase angle is plotted against the exponent alpha for a range of material compositions, lamina and laminate thickness, as well as coil winding configurations. In the "coil series" data illustrated in FIG. 17, fixed pole pieces of the materials indicated were installed in a range of coils corresponding to winding levels from 6300 turns of 42 awg copper wire to 11000 turns of 44.5 awg copper wire. The dimensions of the coils were similar to the reference coil described earlier, with a stadium cross section nominal inner width of 0.097", inner length of 0.504" and height of 0.590".

The behavior falls clearly into two distinct regimes, a phase angle saturated regime, for values of the exponent alpha below about 0.42, and an alpha saturated regime, for values of alpha above about 0.42. The slope varies only weakly at alpha values below about 0.42, increasing from around −165 to only about −135 at low alpha. The alpha value drops dramatically in this regime falling to as low as 0.29 for a 0.062" thick sample of iron. In contrast, for alpha values approaching 0.5, alpha tends to saturate while the slope value varies dramatically. These regimes can be identified as defining characteristics that are more "AlNiCo-like" in the alpha saturated regime and more "Iron-like" in the slope saturated regime. This framework can be utilized to identify materials and material configurations that are more suited to constructing pickups exhibiting a tonality matching that of traditional Stratocaster-style single coil pickups, by selecting more "AlNiCo-like" characteristics. In fact, a range of tonal response can be obtained across the "Stratocaster® tonal spectrum", spanning responses substantially similar to the range of AlNiCo alloys as illustrated in FIG. 17. The inventor has determined that the AlNiCo alloys AlNICo 2 and AlNICo 5 substantially represent the full range of electromagnetic behavior in the commercially available range of AlNiCo alloys, which includes but is not limited to AlNiCo 2, AlNiCo 3, AlNiCo 4, AlNiCo 5 and AlNiCo 8. Note that the AlNiCo 2 pole piece resides at the upper boundary of the alpha saturated regime and the AlNiCo 5 pole piece resides in a region approaching the ideal alpha value of 0.5, and that a range of laminated pole pieces span a substantially similar range. Referring back to FIG. 16, it can be seen that the AlNICo-like regime corresponds to lamina thicknesses below about 0.015" and 0.040" for low carbon steels and 400 series stainless steels respectively.

Figure 18A:
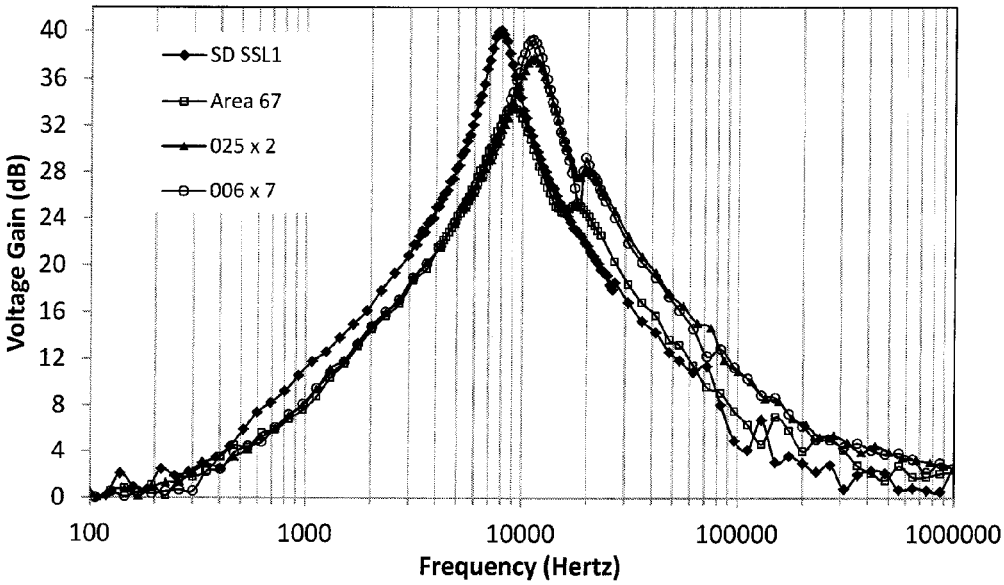
FIGS. 18*a*, 18*b* and 18*c* illustrate phase angle and gain as a function of normalized frequency for pickups targeted at an AlNiCo-like response with the novel methodology and novel materials discussed herein compared to commercially available traditional pickups.
Figure 18B:
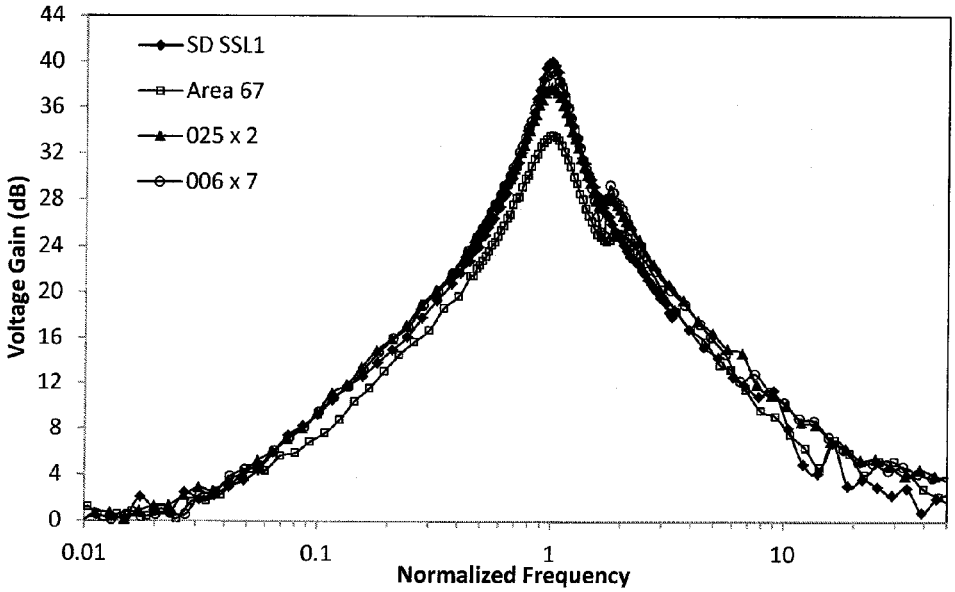
Figure 18C:
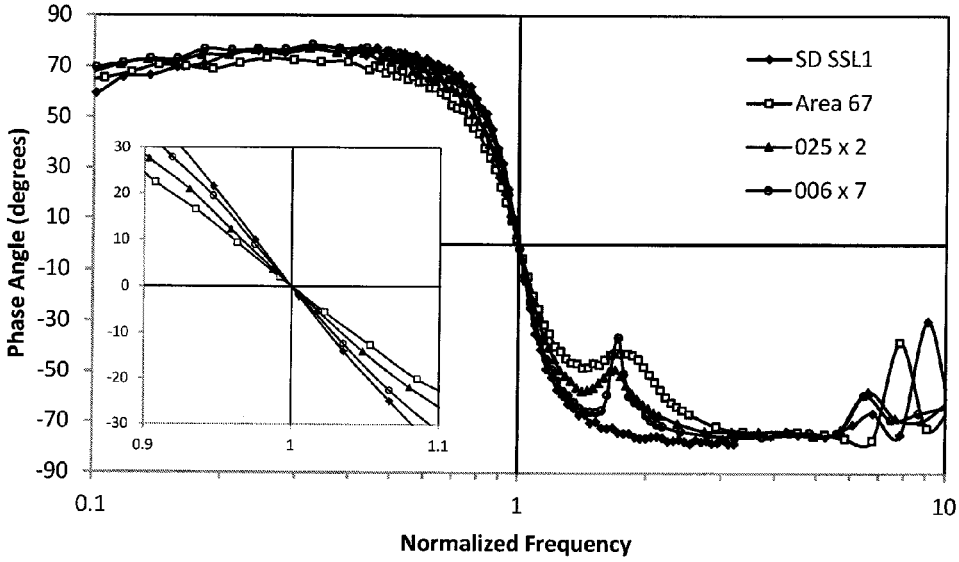

A preferred design regime for an AlNiCo-like response can then be defined for alpha values above about 0.42, and slope values less than about −165. Referring back to FIG. 16, these values correspond to lamina thickness at or below about 0.015" for low carbon steel and as high as 0.040" for 430 stainless steel. Similarly, in the "iron-like" regime, responses similar to P.A.F. type hum-bucking pickups (which typically utilized low carbon steel or iron screws and slugs as pole pieces) can be obtained. A range of these behaviors can be targeted, and even more transitional tones, especially with the 430 stainless steel alloys. FIG. 18 illustrates how these techniques can be used to construct a series of full size pickups spanning a wide range of AlNiCo-like response. The figure shows relative gain as a function of frequency, and gain and phase angle as a function of normalized frequency. Two different examples utilizing the platform and methodology outlined here, representing pickups of the type illustrated in FIGS. 1-4 with pole piece materials and configurations identified utilizing the model described above are compared to two commercially available pickups. The commercial pickups are a Seymour Duncan® SSL-1, representing a standard "vintage" design incorporating cylindrical AlNiCo 5 pole pieces, and a DiMarzio® Area 67, representing what many consider to be the state of the traditional art in noiseless pickup design for a vintage Stratocaster® tone. Note that the pickups of the type disclosed here are very similar to the vintage design pickup, especially in terms of their response versus normalized frequency. The Area 67 pickup, by contrast, exhibits an attenuated response both in terms of gain and phase angle. Note particularly that the resonance peak associated with the Area 67 pickup achieves a much lower maximum normalized gain than the other three pickups illustrated in FIG. 18*a*. The Area 67 exhibits resonance at a frequency of about 9000 Hz and a voltage gain of only about 33 dB, whereas the voltage gain for the other three pickups are nearly 40 dB or higher.

For reference expanded views of the behavior near resonance are provided as insets on the normalized plots. Note that these embedded expanded views do not correlate to the scale on the major x and y axes and are provided for qualitative reference only.

Note that the nominal pole piece configuration of the two embodiments represented in FIG. 18 comprise 2 laminae of 0.025" 430 stainless steel and 7 lamina of 0.006" stainless steel respectively. In order to maintain a balanced output, it is desirable to add additional lamina to the pole piece associated with the D string. For example, a 0.010" lamina may be added to the 2×0.025" pole piece and an additional 0.006" lamina may be added to the 7×0.006" pole piece.

The effect of pole piece composition is evident throughout this discussion, but especially when considering data such as the slope as a function of lamina thickness plot in FIG. 16. A wide range of saturation thicknesses can be extrapolated from these data, based on the position of the Hiperco50 and AlNiCo points, even if samples of these materials are not readily available in a range of thickness in order to construct the entire curve. Note that the AlNiCo alloys in FIG. 16 would be expected to exhibit much higher saturation thickness than the steel alloys discussed here. The Hiperco50 alloy appears to exhibit behavior intermediate between the steel and AlNiCo alloys. As such the Hiperco50 might be expected to yield tonal response even more like AlNiCo than the steel examples already shown. Other, as yet unidentified alloys may yield even higher saturation thickness, and as such interesting performance for approaching AlNiCo-like behavior. Any alloy, existing or envisioned, could be analyzed using the techniques outlined here in order to design a desired tonal behavior.

Other coil designs and measurement systems may yield results that while not in strict quantitative agreement with the information presented here can still be analyzed in the same framework. While not intended to be an exhaustive list, some factors that may influence measurement accuracy would be: coil geometry, compatibility of sample shape and size with the coil configuration, coil winding levels and wire gauge, choice of measurement system, configuration and component values. In all such cases, the important point is capturing the intrinsic performance characteristics of the pole piece material and material configuration both independently and as compared to reference samples. As such, the measurement methods and configurations taught here should serve as the standard basis for material comparison. The possibility that the saturation thickness values of some materials may be affected by coil, pole piece or measurement configuration and geometry cannot be excluded. Here the important point is the identification of the preferred configuration and ranges, especially as they pertain to pole piece composition, lamina thickness and geometry, through the methods disclosed here.

With respect to the use of laminations in low carbon steels, note that while there is significant "improvement" in inductive behavior at decreasing layer thickness and especially below about 0.015" layer thickness, the general electro-magnetic response becomes more ideal continuously as layer thickness is reduced and may be extrapolated to continue to a theoretical layer thickness of zero. As FIGS. 11, 12 and 16 indicate; the exponent alpha approaches the ideal value of 0.5, the inductance increases and the peak width decreases as the layer thickness is reduced. The resonant frequency also decreases with decreasing lamina thickness, whereas the generally accepted interpretation of approaching "ideal" tonal behavior, the general sense among those skilled in the art being that higher resonant frequencies yield more "transparent" tonal response, might suggest that it should increase. This response in particular highlights the complex and sometimes non-intuitive behavior that is observed in the electromagnetic and frequency/inductive responses and the need for and utility of the characterization and modeling methodology taught herein. Also it can be noted that utilizing laminations consisting of the thinnest possible layers can provide for a pickup with the most "transparent" response (note especially the minimization of slope of the tangent to the phase angle) while maximizing inductance. A preferred embodiment of these types of pickups can be constructed with pole pieces manufactured from C1008 laminated shim stock (Composition 4) in layer thicknesses of 0.002" (Class 1) or 0.003" (Class 2).

With respect to the use of laminations in 400 series stainless steels, the inventor has noted similar behavior with 410, 430 and 440 stainless steel. 430 stainless steel is most preferred due to its relative cost and availability. The exponent alpha saturates at about 0.025" lamina thickness, although the slope of the phase angle at resonance decreases monotonically with thickness, apparently down to a theoretical thickness of zero. In general, 430 stainless steel exhibits AlNiCo-like characteristics at thickness below about 0.040" and as such, an "AlNiCo-like" response can be dialed in across this entire range.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

Other than in the operating examples or where otherwise indicated, all numbers or expressions referring to quantities of ingredients, reaction conditions, etc. used in the specification and claims are to be understood as modified in all instances by the term "about." Accordingly, unless indicated to the contrary, the numerical parameters set forth in the following specification and attached claims are approximations that can vary depending upon the desired properties, which the present invention desires to obtain. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

Also, it should be understood that any numerical range recited herein is intended to include all sub-ranges subsumed therein. For example, a range of "1 to 10" is intended to include all sub-ranges between and including the recited minimum value of 1 and the recited maximum value of 10; that is, having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

For purposes of the description hereinafter, the terms "upper", "lower", "right", "left", "vertical", "horizontal", "top", "bottom", "height", "length", "width" and "thickness" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

What is claimed is:

1. A pickup for a stringed musical instrument comprising;

a. at least one coil;

b. at least one pole piece disposed within the at least one coil, wherein the pole piece consists essentially of a magnetically permeable material other than an AlNiCo alloy, and the magnetically permeable material has an inductive response alpha ($\alpha$) between about 0.42 and about 0.5 defined as: $\alpha=-\log_{L_{r\text{-}rel}}(\omega_{r\text{-}rel})$, where $L_{r\text{-}rel}$ is the inductance of a reference coil as measured with the magnetically permeable material disposed therein divided by the inductance of the reference coil as measured without the magnetically permeable material disposed therein and where $\omega_{r\text{-}rel}$ is the resonant frequency of the reference coil as measured with the magnetically permeable material disposed therein divided by the resonant frequency of the reference coil as measured without the magnetically permeable material disposed therein; and c. at least one magnet.

2. The pickup of claim 1 wherein the pole piece comprises plural sheets of magnetic stainless steel and the average sheet thickness is no more than about 0.040".

3. The pickup of claim 1 wherein the pole piece comprises plural sheets of low carbon steel and the average sheet thickness is no more than about 0.015".

4. The pickup of claim 1 wherein the pole piece comprises at least one sheet of the magnetically permeable material and wherein alpha ($\alpha$) is substantially saturated as a function of average sheet thickness.

5. The pickup of claim 1 wherein the magnetically permeable material has a phase angle slope the absolute value of which is above about 150, wherein the slope is defined as the change in phase angle divided by the change in normalized frequency in the vicinity of the resonant frequency as measured with the permanently magnetically material disposed in the reference coil, and wherein the normalized frequency is defined as frequency divided by the resonant frequency as measured with the magnetically permeable material disposed in the reference coil.

6. The pickup of claim 5 wherein the pole piece comprises at least one sheet of the magnetically permeable material and the slope of the phase angle in the vicinity of resonance of the magnetically permeable material disposed within the coil is not substantially saturated as a function of average sheet thickness.

7. The pickup of claim 5 wherein alpha ($\alpha$) is substantially saturated as a function of the slope of the phase angle in the vicinity of resonance.

8. The pickup of claim 1 wherein the pole piece comprises plural sheets and the thickness of at least one of the sheets is less than about 0.062".

9. The pickup of claim 1 wherein the pole piece is a cylinder.

10. The pickup of claim 1 wherein the pole piece is comprised of plurality of sheets which are laminated together.

11. A pickup for a stringed musical instrument comprising;

a. at least one coil; and b. at least one pole piece disposed within the at least one coil, wherein the pole piece consists essentially of a permanently magnetic material other than AlNiCo alloy, and the permanently magnetically material has an inductive response alpha ($\alpha$) between about 0.42 and about 0.5 defined as: $\alpha=-\log_{L_{r\text{-}rel}}(\omega_{r\text{-}rel})$, where $L_{r\text{-}rel}$ is the inductance of a reference coil as measured with the permanently magnetically material disposed therein divided by the inductance of the reference coil as measured without the permanently magnetically material disposed therein, and where $\omega_{r\text{-}rel}$ is the resonant frequency of the reference coil as measured with the permanently magnetically material disposed therein divided by the resonant frequency of the reference coil as measured without the permanently magnetically material disposed therein.

12. The pickup of claim 11 wherein the permanently magnetically material has a phase angle slope the absolute value of which is above about 150, wherein the slope is defined as the change in phase angle divided by the change in normalized frequency in the vicinity of the resonant frequency as measured with the permanently magnetically material disposed in the reference coil, and wherein the normalized frequency is defined as frequency divided by the resonant frequency as measured with the permanently magnetically material disposed in the reference coil.

13. The pickup of claim 12 wherein the value of alpha ($\alpha$) is substantially saturated as a function of the slope of the phase angle in the vicinity of resonance.

14. The pickup of claim 11 wherein the pole piece is a cylinder.

* * * * *